United States Patent [19]

Oya et al.

[11] 4,402,245

[45] Sep. 6, 1983

[54] ELECTRONIC MUSICAL INSTRUMENT WITH SPECIAL TONE GENERATOR

[75] Inventors: Akiyoshi Oya; Takashi Ubayama, both of Hamamatsu; Hideo Suzuki, Shizuoka, all of Japan

[73] Assignee: Nippon Gakki Seizo Kabushiki Kaisha, Shizuoka, Japan

[21] Appl. No.: 256,824

[22] Filed: Apr. 23, 1981

[30] Foreign Application Priority Data

Apr. 30, 1980 [JP] Japan ..... 55-57715

[51] Int. Cl.[3] ..... G10H 1/22; G10H 1/36

[52] U.S. Cl. ..... 84/1.17; 84/1.24; 84/DIG. 2

[58] Field of Search ..... 84/1.01, 1.03, 1.24, 84/DIG. 2, DIG. 12, DIG. 22, 1.17

[56] References Cited

U.S. PATENT DOCUMENTS

| | | | |
|---|---|---|---|
| 4,192,211 | 3/1980 | Yamaga et al. | 84/1.01 |
| 4,214,500 | 7/1980 | Adachi et al. | 84/1.01 |
| 4,217,804 | 8/1980 | Yamaga et al. | 84/1.03 |
| 4,235,142 | 11/1980 | Nakada et al. | 84/1.03 |
| 4,275,634 | 6/1981 | Imamura et al. | 84/1.03 |
| 4,287,802 | 9/1981 | Imamura et al. | 84/1.01 |
| 4,350,068 | 9/1982 | Suzuki et al. | 84/1.01 |
| 4,351,214 | 9/1982 | Suzuki et al. | 84/1.03 |
| 4,351,220 | 9/1982 | Yamada et al. | 84/1.24 |

*Primary Examiner*—Stanley J. Witkowski
*Attorney, Agent, or Firm*—Blakely, Sokoloff, Taylor & Zafman

[57] ABSTRACT

In an electronic musical instrument, there are provided a main musical tone generator for producing a main musical tone and a submusical tone generator for producing a submusical tone different from the main musical tone. The main musical tone generator has a plurality of tone production channels smaller than a total number of keys, the assignment of key information data corresponding to a depressed key to the tone production channel is changed according to a performance mode. The tone production channels and the key information data corresponding to depressed keys are divided into at least two groups respectively in the case of performance mode. One group of the tone production channels is assigned to one group of the tone production channels to produce the main musical tone for an automatic accompaniment, whereas another group of the key information data is assigned to the remaining group to produce the main musical tone for melody. In the submusical tone generator the key information data corresponding to the highest tone among the main musical tones for melody is used to produce the submusical tone.

10 Claims, 13 Drawing Figures

| TIME SLOT | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| KD1 | "1" | — | B1 | N1 | B1 | N1 | 〃 | 〃 | 〃 | 〃 | 〃 | 〃 | 〃 | 〃 | 〃 | 〃 | 〃 | 〃 | 〃 | 〃 | B1 | N1 |
| KD2 | "1" | ABC | B2 | N2 | B2 | N2 | | | | | | | | | | | | | | | B2 | N2 |
| KD3 | "1" | — | B3 | N3 | B3 | N3 | | | | | | | | | | | | | | | B3 | N3 |
| KD4 | "1" | — | KON | N4 | KON | N4 | | | | | | | | | | | | | | | KON | N4 |
| CHANNEL TIMING | — | | 3 | | 5 | | 7 | | 9 | | 11 | | 2 | | 4 | | 6 | | 8 | | 10 | |
| CHANNEL | — | | ch1 | | ch2 | | ch3 | | ch4 | | ch5 | | ch6 | | ch7 | | ch8 | | ch9 | | ch10 | |
| $\overline{ABC}$ | — | | U | | U | | U | | U | | U | | U | | U | | U | | U | | U | |
| ABC | — | | L | | L | | L | | L | | A | | P | | U | | U | | U | | U | |

FIG.9 (a)
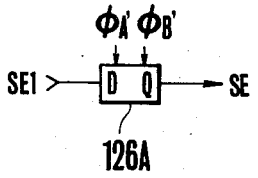
FIG.9 (b)
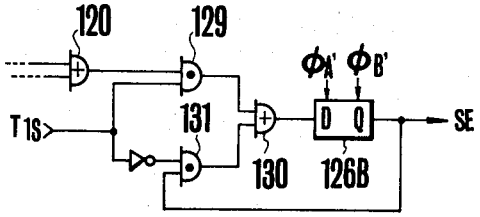
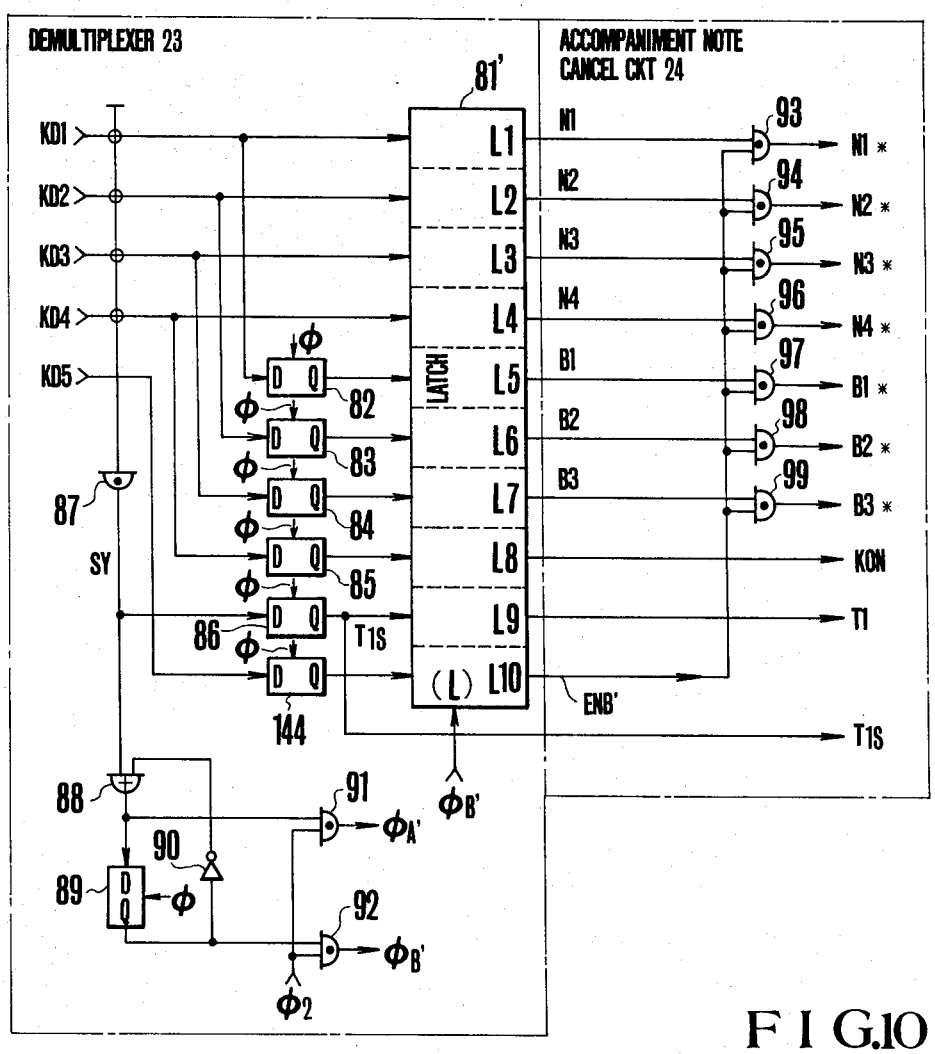
FIG.10

ELECTRONIC MUSICAL INSTRUMENT WITH SPECIAL TONE GENERATOR

BACKGROUND OF THE INVENTION

This invention relates to an electronic musical instrument, more particularly an electronic musical instrument having a plurality of musical tone production channels of the number lesser than the total number of keys.

In an electronic musical instrument having an upper keyboard generally used for a melody performance and a lower keyboard generally used for an accompaniment performance, the tone colors of the tones respectively produced by the upper and lower keyboards are usually different. To this end, it is necessary to provide a plurality of musical tone production channels for each of the upper and lower keyboards. This type of an electronic musical instrument is disclosed, for example in U.S. Pat. No. 4,192,211 dated Mar. 11, 1980. The number of the musical tone production channels for each of the upper and lower keyboards should be equal to the maximum number (for example about 10) of the tones which are produced simultaneously, because only the upper keyboard or the lower keyboard is performed with both hands. In a normal performance mode, however, in which both upper and lower keyboards are used, that is the melody performance is performed with the right hand using the upper keyboard and the accompaniment performance is performed with the left hand using the lower keyboard. In such a case, the number of the musical tone production channels actually used is substantially smaller (about 1 to 3 channels) than the total number of the tone production channels of the upper and lower keyboards, so that many tone production channels are left idle.

In an electronic musical instrument having a single keyboard, the keyboard is divided into high and low tone key ranges so as to perform a melody with the high tone key range and to perform an accompaniment with the low tone key range to produce tones of different tone colors. In the electronic musical instrument too, a plurality of independent musical tone production channels are provided for the melody and the accompaniment tones but the number of the channels of each group is not so large thereby decreasing the number of idle channels. However, where it is desired to perform a performance (for example to simultaneously produce a pluraity of tones with a melody tone color) apart from a predetermined performance mode (for example one tone for the melody and 3 concurrent tones for the accompaniment) such performance is impossible with an electronic musical instrument with a limited number of musical tone production channels for a melody.

For the reason described above, electronic musical instruments have been proposed as described in U.S. Pat. Nos. 4,351,214 and 4,365,532, said patents being owned by assignee of this application, in which, instead of fixing the relation between the musical tone production channels and the key ranges or keyboards, the relation is made variable according to the performance mode so as to utilize all musical tone production channels for producing melody tones over the entire key range or to utilize the musical tone production channels for the melody tone (a specific key range tone) or for the accompaniment tone (the other key range tone).

More particularly, in order to detect the specific note of the melody with the special musical tone production system it is necessary to take in an information representing a note (melody) assigned to musical tone production channels used to produce a melody and then detect a predetermined note (the highest note) out of the information. However, as above described, the range of the musical tone production channels utilized to produce a melody tone is changed in accordance with the performance mode, it is necessary to execute the detection operation by always taking into consideration the performance mode. If a predetermined note were detected from a definite channel range (for example all channels), a note (for example an accompaniment tone) different from the melody note would be detected thus causing the special musical tone production system to produce an unnatural tone.

SUMMARY OF THE INVENTION

It is an object of this invention to provide an electronic musical instrument having a plurality of tone production channels of a number smaller than the total number of keys.

According to this invention, there is provided an electronic musical instrument comprising a keyboard provided with a plurality of keys, means for designating a performance mode, tone production assignment means for dividing key information data corresponding to depressed keys into at least two groups according to a designated performance mode, and for dividing tone production channels of a number of smaller than a total number of the keys into at least two groups according to the designated performance mode thereby assigning divided key information data to corresponding musical tone production groups, and means for producing a submusical tone designated performance mode different from a main musical tone according to key information data assigned by the tone production assignment means.

More particularly, according to this invention, in accordance with a selected performance mode, tone production channels corresponding to a specific musical tone production mode (for example a melody performance) are discriminated from tone production channels corresponding to the other musical tone production mode (for example an accompaniment performance, and cancel means is provided which depending upon such discrimination, selects only the key information data corresponding to the specific musical tone production mode from the key information data representing tones assigned to respective channels and cancels (eliminates key information data of the other channels).

The key information data satisfying a predetermined condition are selected out of the key information data selected by the cancel means so as to produce a musical tone corresponding to the detected key information data with a special musical tone production system. A predetermined condition for detecting the key information data selected by the cancel means may be any condition, such as a highest or lowermost note.

According to a modified embodiment of this invention, the highest or lowermost note of the key information data detected by the cancel means is selected and when the key information data of the highest or lowermost note newly detected is separated more than a predetermined interval than the key information data of the highest or lowermost tone detected immediately before, production of a musical tone corresponding to the new highest tone with the special musical tone production system is prohibited. However, instead of the highest or lowermost note, a note at a desired pitch order (for example the second highest note) among the key information data selected by the cancel means can also be detected. In this case, however, since the number of the key information data selected by the cancel means is limited, (for example only one note), the same key information data is repeatedly counted until the desired pitch order is reached. The detected key information data is not limited to one note but may be a plurality of notes, in which case the special musical tone production system produces a plurality of special musical tones.

BRIEF DESCRIPTION OF THE DRAWINGS

In the accompanying drawings:

FIGS. 3*a* through 3*c* are timing charts useful to explain the operation time relationship of the circuits shown in FIG. 2, in which FIG. 3*a* is depicted with an enlarged time scale than that of FIG. 3*b* and FIG. 3*b* is depicted with an enlarged time scale than that of FIG. 3*c;*

FIGS. 9*a* and 9*b* show modifications of the tone production control circuit shown in FIG. 6; and FIG. 10 is a connection diagram showing modifications of the data demultiplexer and the accompaniment tone cancel circuit shown in FIG. 10.

DESCRIPTION OF THE PREFERRED EMBODIMENTS

General Construction

Figure 1:
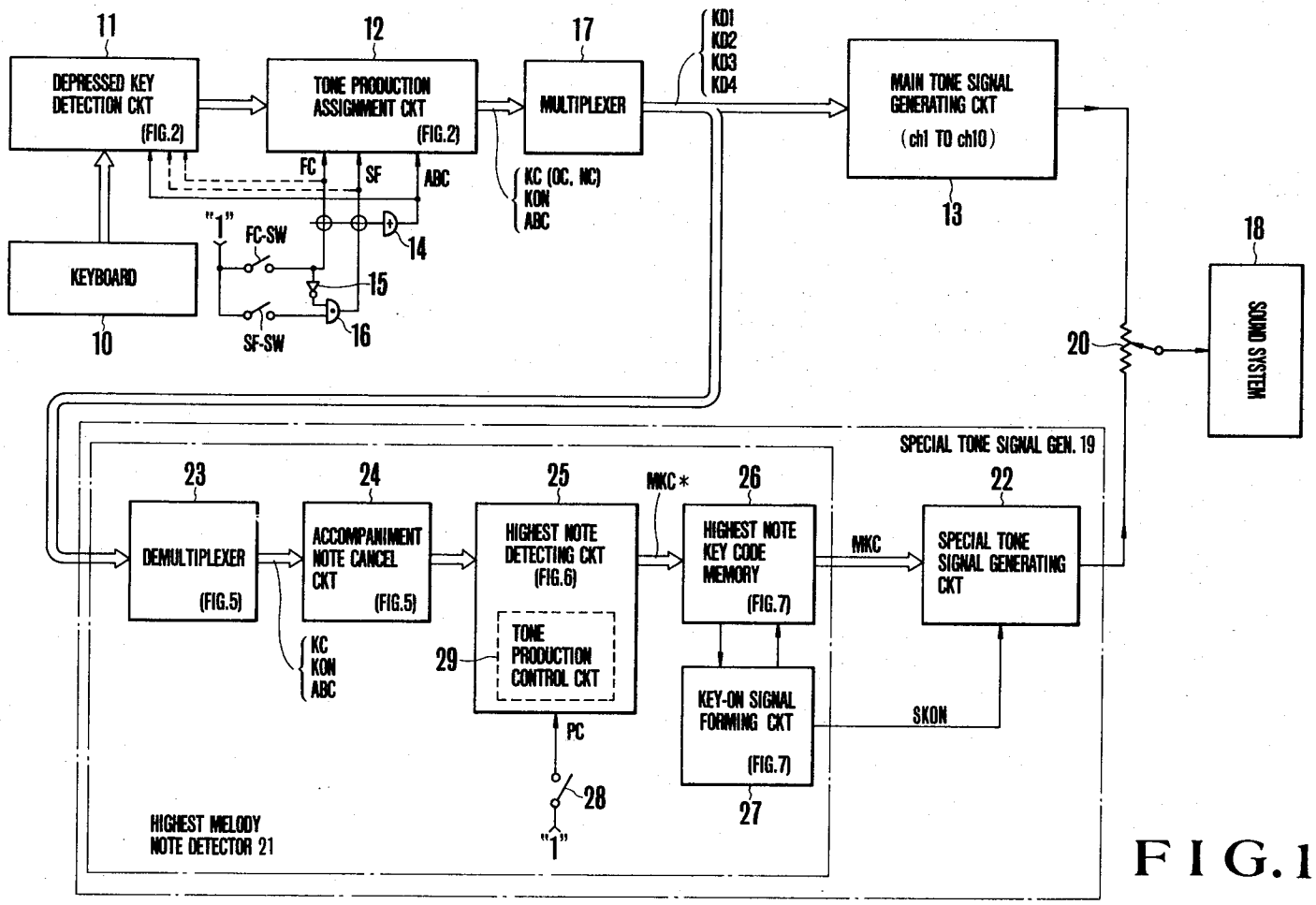
FIG. 1 is a block diagram showing the entire construction of one embodiment of an electronic musical instrument according to this invention.

In a preferred embodiment of this invention shown in FIG. 1, a keyboard 10 is shown as comprising a single stage keyboard having a plurality of keys. A depressed key detection circuit 11 is provided for detecting depression and release of keys of the keyboard 10 to supply an information representing a depressed key to a tone production assignment circuit 12. The tone production assignment circuit 12 assigns the tone production of a depressed key to any one of a plurality of musical tone production channels for producing, in response to such assignment, a key code KC constituted by a plurality of bits and used to specify the depressed key, and an one bit key-on signal KON (which is "1" when a key is depressed but "0" when the key is released) representing depression or release of the key. In the tone production assignment circuit 12, the relation between the depressed key and a musicl tone production channel to which the tone production of the depressed key is to be assigned is not always fixed but suitably changed according to the performance mode.

In this embodiment, there are two performance modes that change the relation between respective keys of the keyboard 10 and the musical tone production channels (groups) to which the tone productions of these keys are to be assigned. According to the first mode, the keyboard and all musical tone production channels are made to correspond to the first musical tone production mode (for example, a melody performance), whereas according to the second mode, the keyboard and a group of a predetermined ones of the musical tone production channels are made to correspond to the first musical tone production mode (melody performance), while the remaining groups are made to correspond to the second musical tone production mode (for example, an accompaniment performance). In this embodiment, the circuit is constructed such that the performance modes described above are switched in an interlocked relationship with the selection of an automatic base chord performance. For this reason, in this embodiment no selector is used for selecting either one of the first and second modes described above, but selection switches (FC-SW and SF-SW) for the automatic bass chord performance are used as means for selecting either one of the first and second modes.

In the electronic musical instrument shown in FIG. 1, a state in which the automatic bass chord performance is not selected is called a "normal mode" which corresponds to the first mode described above. Where an automatic bass chord performance is not selected, all musical tone production channels are utilized in common for all keys so that all keys of the keyboard 10 are used to produce tones in a first musical tone production mode (melody performance). A state in which the automatic bass chord performance is made is termed an "automatic bass chord mode" which corresponds to the second mode described above. More particularly, in the automatic bass chord mode, a key range occupying a portion of the keyboard 10 and certain numbers of the musical tone production channels are made to correspond to the second musical tone production mode (an accompaniment performance, more particularly an automatic bass chord performance and an automatic arpeggio performance), while the remaining key range and the musical tone production channels are made to correspond to the first musical tone production mode (melody performance). The key range corresponding to the second musical tone production mode is called an "accompaniment key range" (LK), while the key range corresponding to the first musical tone production mode is called a "melody key range" (UK).

A main musical tone signal generating circuit 13 is provided with 10 musical tone production channels ch1 through ch10. These channels are divided into groups corresponding to the performance modes so as to form musical tones commensurate with the first musical tone production mode (melody performance) or the second musical tone production mode (accompaniment mode). The tone production assignment circuit 13 assignes the tone production of the depressed key to either one of the channels ch1 through ch10 in the main musical tone signal generating circuit 13 in accordance with the performance keys. To this end, the tone production assignment circuit 12 is supplied with a signal ABC (or FC or SF) representing the performance mode.

The signal ABC representing the performance mode is produced by operating switch FC-SW that selects a fingered chord mode of the automatic bass chord performance or the switch SF-SW that selects a single finger mode. When the fingered chord mode selection switch FC-SW or the single finger mode selection switch SF-SW is closed, the output of an OR gate circuit 14 inputted with the outputs of these switches FC-SW and SF-SW becomes "1". Thus the signal ABC (automatic bass chord mode signal) outputted from the OR gate circui 14 becomes "1". As above described, this means that the keyboard 10 and the musical tone production channels ch1 through ch10 are divided to be utilized. The output "1" of the swtich FC-SW is inverted by an inverter 15 and then applied to one input of an AND gate circuit 16 so as to block the output of the switch SF-SW, thus giving a priority to the fingered chord mode FC instead of the single finger mode SF.

When switches FC-SW and SF-SW are both open, the automatic bass chord mode signal ABC outputted from the OR gate circuit 14 is "0" meaning that the automatic bass chord performance is not selected, that is the mode is the normal mode.

One example of how to selectively use the key ranges of the keyboard 19 and the musical tone production channels ch1 through ch10 according to the performance modes is shown in the following Table I. It is assumed that the keyboard 10 is provided with 61 keys covering the lowermost key C2 through the highest key C7.

TABLE I

| Accompaniment key range (LK) | Key C2 through C3 |
|---|---|
| In the automatic bass chord mode (ABC = "1") | |
| accompaniment channel | ch1 through ch6 (ch1 through ch4 are used for a chord, ch5 is used for the automatic arpeggio, ch6 is used for the bass tone) |
| melody keys (UK) | keys C#3 through C7 |
| melody channels | ch7 through ch10 |
| In the normal mode (ABC = "0") | |
| melody key range (UK) | keys C2 through C7 |
| melody channels | ch1 through ch10 |
| accompaniment key range and accompaniment channel | no |

According to the state of the mode signal ABC ("1" or "0") outputted from the OR gate circuit 14, the tone production assignment circuit 12 judges a key range (accompaniment key range LK or melody key range UK) to which a depressed key indicated by a depressed key information given by the depressed key detection circuit 11 belongs. Furthermore the tone production assignment circuit 12 divides the tone production channels ch1 through ch10 into the groups as shown in Table I and assigns the depressed key in the melody key range (UK) to either one of the melody channels, whereas assigns the note (chord, bass and automatic arpeggio) produced by a depressed key in the accompaniment key range LK to either one of the accompaniment channels. The tone production assignment circuit 12 is provided with a circuit which forms a key information of the automatic accompaniment tone. The output of the fingered code mode selection switch FC-SW, that is a fingered code mode signal FC, and the output of the single finger mode selection switch SF-SW, that is a single finger mode signal SF passing through the AND gate circuit 16 are applied to the tone production assignment circuit 12 so as to form a key information or a code FC of the automatic accompaniment tone in the fingered chord mode FC or a key information or a code of the automatic accompaniment note in the single finger mode SF depending upon the output FC or SF of these switches.

When the fingered code mode FC is "1", the key information corresponding to one to several depressed keys of the accompaniment key range LK constitute the key information of the chord constituting tone as it is, so that a key information of an automatic bass note is formed corresponding to the chord and the key information of an automatic arpeggio note would be formed based on this chord.

When the single finger mode SF is "1", key informations of a plurality of chord constituting tones are formed automatically based on a single depressed root note designation key of the accompaniment key range LK and on a chord type designation information, at the same time, key informations of an automatic bass note and an automatic arpeggio note are also formed. As shown in Table I, the key information of the chord constituting note is assigned to either one of the chord production channels ch1 through ch4, while the key information of the automatic arpeggio note is assigned to the arpeggio channel ch5 and the key information of the automatic bass note is assigned to the bass note channel ch6.

A circuit for forming the key information of an automatic accompaniment note (especially an automatic bass and a chord in the single finger mode) may be included in the depressed key detection circuit 11 in which case the signals FC and SF are inputted to the depressed key detection circuit 11 as shown by dotted lines.

The tone production assignment circuit 12 is constructed to form, on the time division basis, timings corresponding to respective channels, so that key informations (key code KC and key-on signal KON) representing a note assigned to each one of the channels ch1 through ch10 is outputted, on the time division basis, in synchronism with each channel timing. The key code is made up of a 4 bit note code NC representing the note name, and a 3 bit octave code representing the octave tone range. Consequently, the key information regarding one channel is a 8 bit data comprising a 7 bit key code KC and an 1 bit key-on signal KON.

A data multiplexer 17 multiplexes 8 bit data for each channel (key code KC and key-on signal KON) supplied from the tone production assignment circuit 12, on the time division basis, into 4 bit data KD1 through KD4. Furthermore the signal ABC representing the performance mode is applied to the data multiplexer 17 via the tone production assignment circuit 12 so that this mode signal ABC too is multiplexed together with the key code CK and the key-on signal KON to form data KD1 through KD4.

The multiplexed data KD 1 through KD4 outputted from the data multiplexer 17 are applied to the main musical tone signal generating circuit 13 which demultiplexes data KD1 through KD4 into key codes KC and key-on signal KON of respective channels, and also demultiplexes the automatic bass chord mode signal ABC. The key codes KC and key-on signals KON of respective channels thus demultiplexed are distributed among corresponding musical tone production channels ch1 through ch10. The musical tone production channels ch1 through ch10 in the main musical tone signal generating circuit 13 form musical tone signals having tone pitches corresponding to the key codes in accordance with the key codes KC and the key-on signals KON distributed or assigned to the channels. When the key-on signal KON is "1", an envelope is applied to the outputted musical tone signal. At this time, when the automatic bass chord mode signal ABC is "1", channels ch1 through ch4 form a musical tone (for applying a tone color) of a chord, channel ch5 forms a tone of an arpeggio (for applying a tone color), and channels ch7 through ch10 form a musical tone (for applying a tone color) for a melody. On the other hand, when the mode signal ABC is "0", all channels ch1 through ch10 form a musical tone (for applying a tone color) for a melody. The musical tone signals formed by respective channels are mixed together and then produced as a musical tone through a sound system 18.

The multiplexed data KD1 through KD4 produced by the data multiplexer 17 are also applied to a special musical tone generator 19 which detects an extreme note (either one of the highest note or the lowermost note, in this example, the former) of the tone that is the melody tone generated by the main musical tone signal generating circuit 13 in the first musical tone generating mode (melody type) and forms a musical tone by using this extreme note (highest note) with a third musical tone generating mode different from the first musical tone generating mode (melody mode). The musical tone signal formed by the special musical tone generator 19 is mixed with the musical tone signal outputted from the main musical tone signal generating circuit 13 with a variable mixing resistor 20 and then applied to the sound system 18. Consequently, a musical tone having the same rhythm as that of the extreme note (highest note) of the melody performance (in the first musical tone production mode) is automatically performed concurrently with the melody performance with a tone color different from that of the inherent melody color thereby emphasizing the melody feeling.

The special musical tone signal generator 19 comprises a highest melody note detector 21 and a special musical tone forming circuit 22. The highest melody note detector 21 comprises a data demultiplexer 23, an accompaniment tone cancel circuit 24, a highest note detector 25, a highest note key code memory device 26, a key-on signal forming circuit 27 and a tone production control mode selection switch 28. The data demodulator 23 demultiplexes not only the multiplexed data KD1 through KD4 into key codes KC and key-on signals KON of respective channels but also the automatic base chord mode signal ABC. The accompaniment tone cancel circuit 24 cancels only the key code KC and the key-on signal KON for the accompaniment channel among the key codes KC and the key-on signals KON for respective channels so as to pass only the key code KC and the key-on signal KON for a melody channel. As above described the channel utilization mode is changed depending upon the performance mode. Accordingly, when the mode signal ABC is "1" (that is the mode is the automatic bass chord mode), the accompaniment tone cancel circuit 24 cancels the key codes KC and the key-on signals KON for channels ch1 through ch6 which are used as the accompaniment channels but selectively outputs the key codes KC and the key-on signals KON regarding channels ch7 through ch10 which are used as the melody channel. On the other hand, when the mode signal ABC is "0" (that is the normal mode) since all channels are used as the melody channels the accompaniment note cancel circuit 24 selects and outputs the key codes KC and the key-on signal KON regarding all channels ch1 through ch10.

The highest note detection circuit 25 detects the key code of the highest note among the key codes KC of the melody channels, that have passed through the accompaniment note cancel circuit 24, and the detected highest note key code MKC is stored in the highest note key code memory device 26. The highest note det etion circuit 25 includes a tone production control circuit 29. When a presently detected highest note is lower than a highest note previously detected by more than a predetermined interval, the tone production control circuit 29 blocks the key code of the presently detected highest note. As the tone production control mode selection switch 28 is closed, the tone production control mode signal PC becomes "1" thus enabling the tone production control circuit 29. When the switch 28 is opened, the tone production control mode signal PC becomes "0" so that the tone production control circuit 29 does not operate.

When the performance mode is in the automatic bass chord mode (ABC is "1"), that is when the channels ch1 through ch10 are divided into the accompaniment channels ch1 through ch6, and the melody channels ch7 through ch10 so that the accompaniment and the melody are performed with different musical tone production modes, the accompaniment note cancel circuit 24 channels the accompaniment tone so as to enable the highest tone detection circuit 25 to detect the highest tone among the melody tones.

When the performance mode is the normal mode (signal ABC="0"), that is when all keys and all channels ch1 through ch10 correspond to the melody musical tone production mode, and when keys in the high key range are operated for producing a melody and the keys in the low key range are operated for producing an accompaniment tone so as to produce the melody and the accompaniment tones with the same tone color (melody tone color), the tone production control circuit 29 substantially cancels the accompaniment tone of the melody tone color so as to produce the only the highest note of the true melody tone as the special musical tone. In such a case (normal mode), the key codes of the keys depressed by the performer with an intension of producing an accompaniment tone are also assigned to the melody channels and supplied to the highest note detecting circuit 25 without being cancelled by the accompaniment tone cancel circuit 24. As a consequence the highest tone detecting circuit 25 detect, the high note including not only the melody but also the accompaniment having the tone color of the molody. Thus whenever keys for producing a true melody are depressed, the key codes of the highest note among the true melody notes would always be detected by the highest note detecting circuit 25.

Because the high key range of the keyboard 10 is used for the melody performance. However, when keys utilized for producing a melody note are momentarily released and in which only the keys for the accompaniment are depressed, the highest note detection circuit 25 would detect the highest note of the keys which are depressed by the performer with an intension of producing the accompaniment. If this higher note of the accompaniment were generated by the special musical tone signal generator 19, the rhythm of the special musical tone which is being automatically performed according to the rhythm (substantially the same rhythm as the melody, of the highest note of the true melody performance would be disturbed. When the highest note detected by the highest note detection circuit 25 changes from the highest note of the true melody produced by the depressed keys in the high key range to the highest note of the accompaniment produced by the depressed keys in the lower key range, the interval of the highest note would be shifted more or less to the low tone side. For this reason, where a presently detected highest note is spaced from the previously detected highest note in the low tone side by more than a predetermined interval the tone production control circuit 29 judges that as if the highest note of the accompaniment were detected as above described with the result that the tone production detecting circuit 29 inhibits the production of the special musical tone, thus disturbing the melody of the special musical tone. In this embodiment, the predetermined interval to be judged by the tone production control circuit 29 is made to be equal to minor 3 degrees (300 cents). More particularly, the tone production is ihibited when the presently detected highest note is spaced in the low tone side from the previously detected highest note by more than minor 3 degrees. It should be understood that the interval is not limited to the minor 3 degrees but may be determined to any interval. Of course, the control of the tone production control circuit 29 is not always normal. Thus, according to the type of a music, the melody interval carries greatly (for example, lowered by more than minor 3 degrees). In order to make versatile the preparation of such abnormal case, the tone production control circuit 29 is not always operative, but selectively made operative when the selection switch 28 is operated.

The key-on signal forming circuit 27 is provided for the purpose of forming a key-on signal SKON corresponding to the highest note key code MKC stored in the highest note key code memory device 26. When a new key code is stored in the highest note key code memory device 26, the key-on signal SKON is changed to "1" with a predetermined time delay (provided by setting a waiting time) and the key-on signal SKON is immediately changed to "0" when a new key code is stored in the highest note key code memory device 26. The waiting time for building up the key-on signal SKON is used for ensuring positive storing of the true highest note key code in the memory device 26 by taking into consideration nonuniform key operating speed.

The highest note key code MKC stored in the highest note key code memory circuit 26 and the key-on signal SKON formed by the key-on signal forming circuit 27 are supplied to the special musical tone signal forming circuit 22 which forms a musical tone having a tone pitch represented by the highest note key code MKC with a this musical tone production mode (a tone color for the special musical tone) which is different from the first musical tone production mode (melody tone color) or the second musical tone production mode (accompaniment tone color) so as to impart an evelope to the musical tone according to the key-on signal SKON.

Tone Production Assignment Circuit and Peripheral Circuits

The tone production assignment circuit 12 utilized in this invention wherein the relation between the keys (key group) and musical tone production channels (channel group) is changed according to the performance mode is disclosed in U.S. Patent application Ser. Nos. 182,464 and 228,782. As the tone production assignment circuit 12 and the peripheral circuits thereof may be used those disclosed in these prior applications, and one example of these circuits are shown in FIG. 2.

Figure 2:
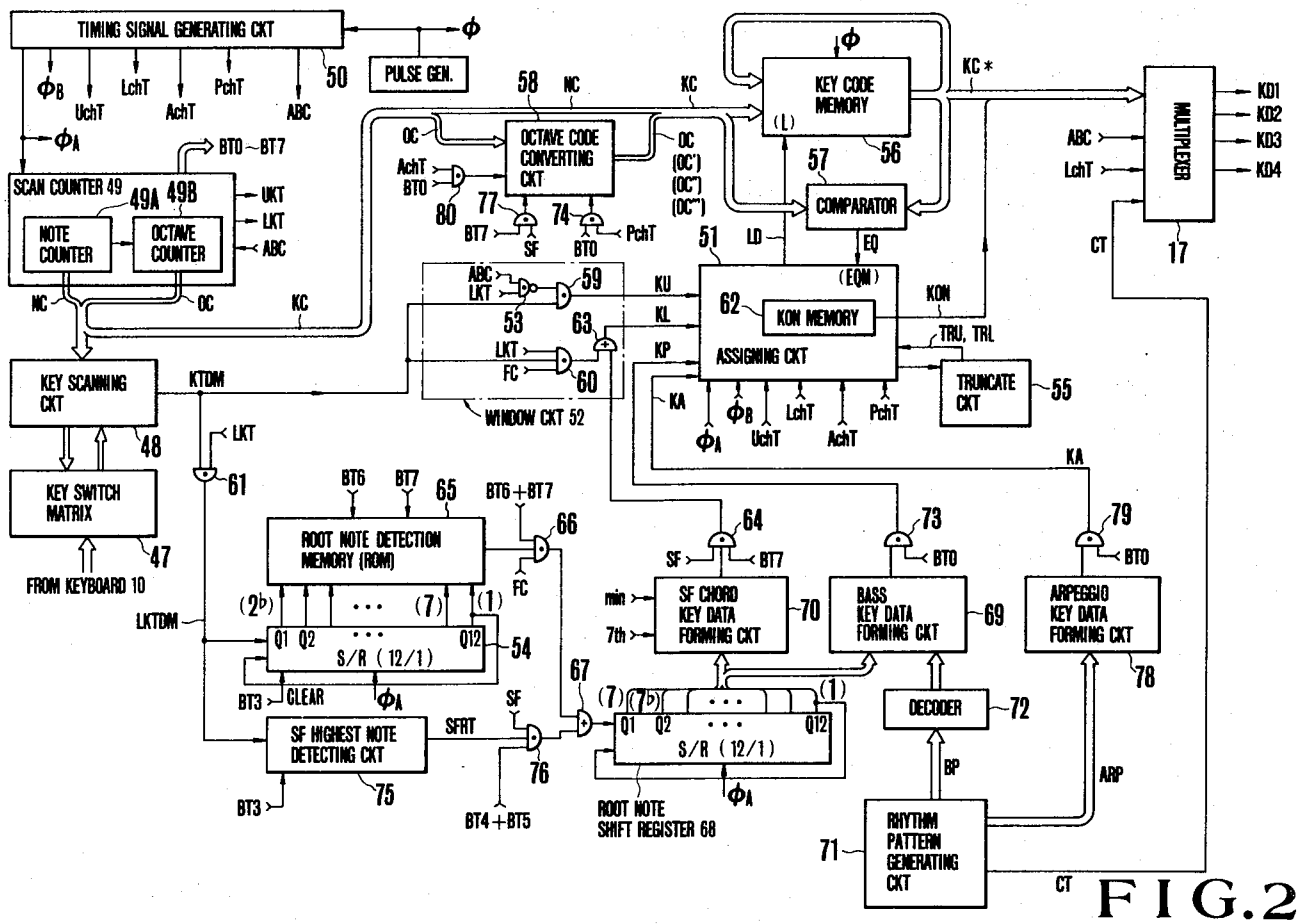
FIG. 2 is a block diagram showing the detail of the tone production assigment circuit and peripheral circuits shown in FIG. 1.

In FIG. 2, a key switch matrix circuit 47 and a key scanning circuit 49, and a scan counter 49 correspond to the depressed key detection circuit 11 shown in FIG. 1 and the key switch matrix circuit 47 comprises a plurality of key switches corresponding to respective keys of the keyboard 10 shown in FIG. 1. Circuit elements except the key switch matrix circuit 47, the key scanning circuit 48, the scan counter 49, the data multiplexer 17 and a rhythm pattern generator 71 correspond to the tone production assignment circuit 12 shown in FIG. 1.

The key scanning circuit 48 sequentially scans the key switches of the key matrix circuit 47 for producing, on a single output line, time divisioned and multiplexed data which show depressed and released states of respective keys according to presence or absence ("1" or "0") in the time slots corresponding to respective keys. The operation of the key scan circuit 48 is controlled by the scan counter 49. The scan counter 49 counts the number of clock pulses $\phi_A$ given by a timing signal generating circuit 50 and constituted by a note counter 49A adapted to count the number of the clock pulses $\phi_A$ and an octave counter 49B utilizing a carry signal generated by the note counter 49A as a count pulse. The key scanning circuit 48 operates to sequentially scan the keys from the high tone side. More particularly, the scan counter 49 produces key codes in the order of the tone pitches, i.e. from the highest note key C7 toward the lowermost note key C2, and in response to the key codes KC supplied from the scan counter 49, the key scanning circuit 48 sequentially scans the keys in the order of from the highest note key C7 to the lowermost note key C2.

Figure 3:
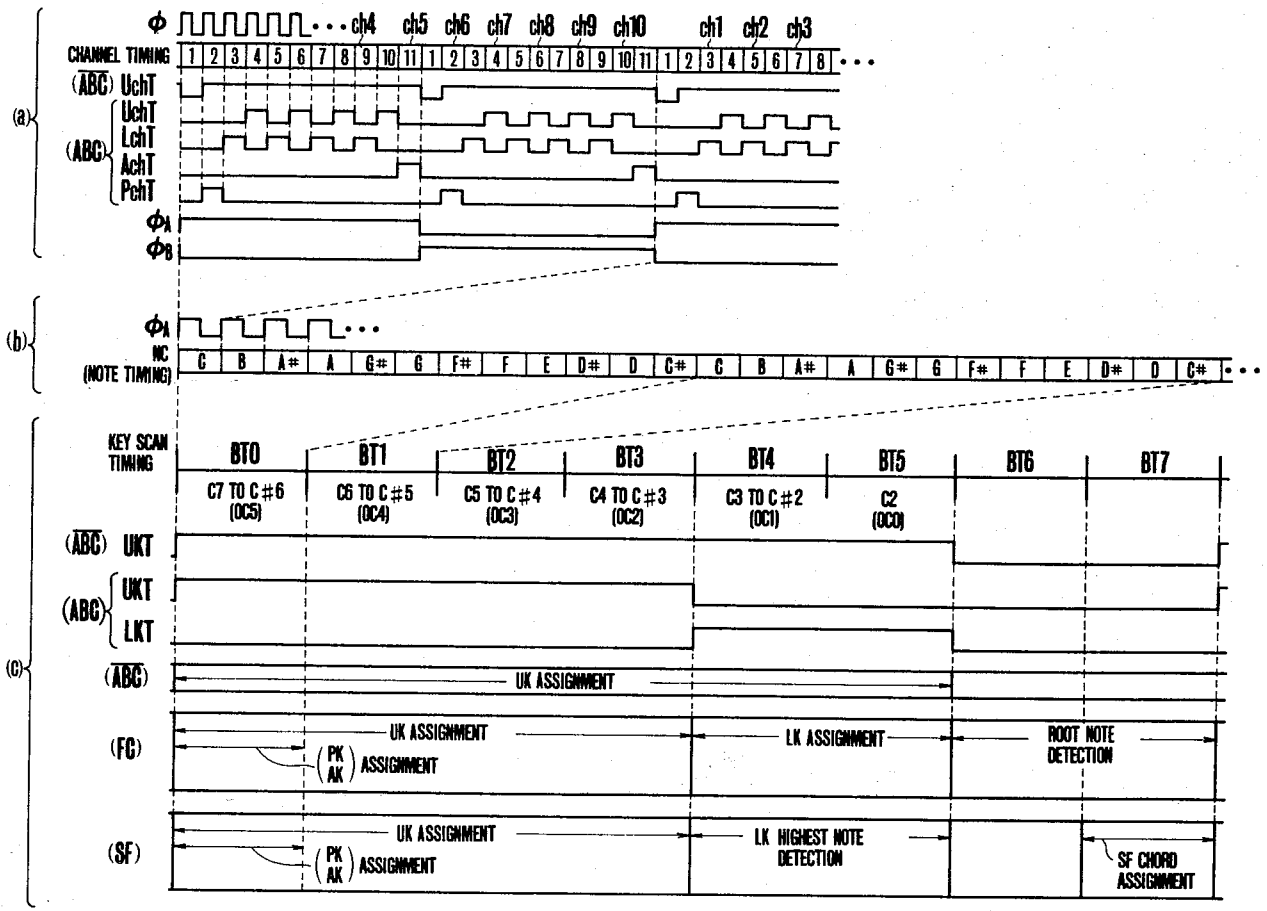

Each key code KC is constituted by a combination of a 4 bit note code NC outputted by a note counter 49A and a 3 bit octave code outputted by a octave counter 49B. As shown in FIG. 3*b*, the content of the note code NC outputted by the note counter 49A varies sequentially in the order of tone pitch, that is from the highest note name C to the lowermost note name C# each time a clock pulse $\phi_A$ is given, and the key switches corresponding to the note names of the note codes NC are scanned by the key switch matrix circuit 47. Each time the note counter 49A counts 12 times, the octave couner 49B counts one. More particularly, when the content of the note counter 49A changes from the lowermost note name C# to the highest note name C, the content of the octave counter 49B changes. As shown in FIG. 3*c*, the octave note range, represented by an octave code OC firstly outputted from the octave counter 49B is the highest octave (OC5) covering key note C7 to key note C#6. At this time signal BTO beomes "1". Thereafter, as shown in FIG. 3*c*, each time the note counter 49A counts 12 note codes NC of from note name C to note name C#, the content of the octave code OC of the octave counter 49B sequentially changes toward lower octaves, (OC4 through OC0) with the result that the signal BT1 through BT7 sequentially becomes "1". Signals BTO through BT7 are outputted from the scan counter 49 in accordance with the content of the octave counter 49B.

The scan counter 49 is applied with an automatic bass chord mode signal ABC for producing a melody key range scanning timing signal UKT and an accompaniment key range scanning timing signal LKT depending upon this mode signal ABC and the state of the octave counter 49B. In the case of the normal mode (ABC is "0"), since all keys C7 through C2 constitute a melody key range (see Table I) the melody key range scanning timing signal UKT is generated corresponding to an interval (an interval in which signals BT0 through BT5 are produced) in which all keys are scanned, but an accompaniment key range scanning timing signal LKT would not be genrated (see $\overline{ABC}$) UKT shown in FIG. 3*c*. In the case of the automatic bass chord mode (ABC is "1"), as shown in the foregoing Table I, keys C7 through C#3 constitute the melody key range, while keys C3 through C2 constitute the accompaniment key range. Consequently, in the case of the automatic bass chord mode, the melody key range scanning timing signal UKT would be produced corresponding to an interval in which keys C7 through C#3 are scanned, (i.e. an interval in which signals BT0 through BT3 are generated), while the accompaniment key range scanning timing signal LKT would be produced corresponding to an interval in which keys C3 through C2 are scanned (i.e. an interval in which signals BT4 and BT5 are produced).

After the scanning timing of the lowermost note key C2 and before the end of an interval between the note timing of the note name B at the time of generation of signal BT5 and the signal BT7, no key data KTDM is produced. After signal BT7, signal BT0 is produced.

One example of the relationship between values of respective bits N4, N3, N2 and N1 of a note code NC generated by the note counter 49A and the note names is shown in the following Table II, and one example of the relationship between the values of bits B3, B2 and B1 of an octave code OC outputted from the octave counter 49B and the octave tone ranges is shown in the following Table III.

TABLE II

| Note name | (NC) N4 | N3 | N2 | N1 | decimal representation |
|---|---|---|---|---|---|
| C | 1 | 1 | 1 | 0 | 14 |
| B | 1 | 1 | 0 | 1 | 13 |
| A# | 1 | 1 | 0 | 0 | 12 |
| A | 1 | 0 | 1 | 0 | 10 |
| G# | 1 | 0 | 0 | 0 | 9 |
| G | 1 | 0 | 0 | 0 | 8 |
| F# | 0 | 1 | 1 | 0 | 6 |
| F | 0 | 1 | 0 | 1 | 5 |
| E | 0 | 1 | 0 | 0 | 4 |
| D# | 0 | 0 | 1 | 0 | 2 |
| D | 0 | 0 | 0 | 1 | 1 |
| C# | 0 | 0 | 0 | 0 | 0 |

TABLE III

| Octave (key) | (OC) B3 | B2 | B1 | decimal representation |
|---|---|---|---|---|
| OC5 (C7 through C#6) | 1 | 1 | 0 | 6 |
| OC4 (C6 through C#5) | 1 | 0 | 1 | 5 |
| OC3 (C5 through C#4) | 1 | 0 | 0 | 4 |
| OC2 (C4 through C#3) | 0 | 1 | 1 | 3 |
| OC1 (C3 through C#2) | 0 | 1 | 0 | 2 |

TABLE III-continued

| Octave (key) | (OC) B3 | B2 | B1 | decimal representation |
|---|---|---|---|---|
| OC0 (C2) | 0 | 0 | 1 | 1 |

The octave code OC (B3 through B1) has a weight above larger than that of the note code (N4 through N1). In the examples shown in Tables II and III, the larger is the value of a key code KC constituted by an octave code OC and a note code NC, the higher is the tone pitch. However, as the key scanning is made form the high tone side, both the note counter 49A and the octave counter 49B perform subtractions. More particularly, at the commencement of the key scanning, the count of the note counter 49A is "1110" which represents the note name "C", while, the count of the octave counter 49B is "110" which represents the note range C7 through C#6, whereby the highest note key C7 is scnned. Thereafter, the subtraction operations are executed sequentially. Although the value of the octave code OC changes from "001" to "000" and then "111", these values do not correspond to the keyboard but correspond to the timings of generating signals BT6 and BT7.

As shown in Table II, the note code NC does not assume values corresponding to decimal numbers [3], [7], [11] and [15]. For this reason, the note counter 49A proceeds counting by jumping over decimal numbers [3], [7], [11] and [15]. Thus, the note counter 49A counts [10] next to decimal number [12], counts [6] next to [8], counts [2] next to [4] and counts [14] next to [0]. Thus this counter comprises a counter of modulo 12 which sequentially count 12 types of the note codes NC as shown in Table II.

A window circuit 52 is provided for the purpose of assigning the multiplexed key data KTDM to either one of the first and second musical tone production modes. In the case of the normal mode, a mode signal ABC applied to an NAND gate circuit 53 is "0" so that the output of the NAND gate circuit 53 becomes 1 thus always enabling an AND gate circuit 59. As a consequence, the multiplexed data applied to the other input of the AND gate circuit 59 is always selected thereby, and applied to an assignment circuit 51. In this manner, in the normal mode, the multiplexed data KTDM regarding all keys C7 through C2 constitute a melody key data.

In the case of the automatic bass chord mode, the mode signal ABC applied to one input of the NAND gate circuit 53 is "1", the other input thereof being connected to receive the accompaniment key range scanning timing signal LKT. As shown by (ABC) LKT shown in FIG. 3*c*, in the case of the automatic bass chord mode, signal LKT becomes "1" when the accompaniment key range (keys C3 through C2) is produced. Consequently, the output of the NAND gate circuit 53 becomes "0" while the key data KTDM regarding the keys in the accompaniment key range are outputted, whereas in the other case, that is when the key data KTDM regarding the keys C7 through C#3 of the melody key range are outputted the output of the NAND gate circuit 53 becomes "1". As a consequence, in the automatic bass chord mode, the multiplexed key data KTDM regarding keys C7 through C#3 are selected by the AND gate circuit 59 to form melody key data KU. In the automatic bass chord mode, as will be described later, chord key data KL, bass tone key data KP, arpeggio tone key data KA are determined according to the multiplexed key data KTDM of the keys C3 through C2 in the accompaniment key range and supplied to the assignment circuit 51.

The assignment circuit 51 assigns key codes KC corresponding to respective key data KU, KL, KP and KA to either one of the channels ch1 through ch10 according to the performance mode respectively, whereas in the normal mode assigns key codes KC corresponding to the melody key data KU to either one of the channels ch1 through ch10. In the case of the automatic bass chord mode, key codes KC corresponding to the melody key data KU are assigned to either one of the channels ch7 through ch10 respectively, whereas the key code KC corresponding to chord key data KL assigned to either one of the channels ch1 through ch4 respectively, key code KC corresponding to the bass tone key data KP is assigned to the channel, and a key code KC corresponding to arpeggio tone key data KA is assigned to the channel ch5.

The assignment circuit 51 processes, on the time division basis, the data corresponding to respective musical tone producing channels ch1 through ch10. As shown in FIG. 3*a* the time divisioned channel timings are [1] to [11] inclusive and channel timings [1] through [11] are repeatedly formed in synchronism with the system clock pulse $\phi$. The correspondence between the musical tone producing channels ch1 through ch10 and the channel timings [1] through [11] is such that timings [3], [5], [7] and [9] correspond to channels ch1, ch2, ch3, and ch4 respectively (the chord channels in the automatic bass chord mode), timing [11] corresponds to channel ch5 (the arpeggio tone channel), timing [2] corresponds to channel ch6 (the base tone channel in the automatic bass chord mode), timings [4], [6], [8] and [10] correspond respectively to channels ch7, ch8, ch9 and ch10, which the timing [1] does not correspond to any actual musical tone production channel. The assignment circuit 51 is supplied with channel timing signals UchT, LchT, AchT and PchT for different production modes from the timing signal generating circuit 50. These channel timing signals UchT, LchT, AchT and PchT are produced in different modes at predetermined channel timings according to the performance modes. The chord channel timing signal LchT, bass tone channel timing signal PchT, bass tone channel timing signal PchT and the arpeggio channel timing signal AchT respectively represent channels to be assigned with key codes KC corresponding to melody key data KU, chord key data KL, bass key data KP and arpeggio key data KA respectively.

As shown by ($\overline{\text{ABC}}$) UchT shown in FIG. 3*a*, in the normal mode (signal ABC is "0") the timing signal generating circuit 50 generates only the melody timing signal UchT corresponding to the channel timings [2] through [11] regarding all channels ch1 through ch10 but not generates other signals LchT, AchT and PchT. As shown by (ABC) UchT, LchT, AchT and PchT shown in FIG. 3*a*, in the automatic bass chord mode (signal ABC is "1") the timing signal generating circuit 50 generates channel timing signals UchT, LchT, AchT and PchT corresponding to perspective channel timings. The timing signal generating circuit 50 further produces a clock pulse $\phi$A and a clock pulse $\phi$B having a phase opposite thereto as shown in FIG. 3*a*. One period of the clock pulse $\phi$A corresponds to 22 periods (22 bit times) of the system clock pulse $\phi$. The clock pulse $\phi$A is "1" during 11 bit times in which 11 channel timings [1] through [11] complete one cycle while "0" during the next cycle of 11 bits.

The outline of the time relationship among various processings during one processing cycle (between the building up of signal BT0 and the building down of signal BT7) is shown by rows ABC, FC, and SF of FIG. 3*c*. The $\overline{\text{ABC}}$ row shows the outline of the processing in the normal mode, in which all keys C7 through C2 constitute the melody keyboard UK so that at the time of scanning (at the times of generating signals BT0 through BT5) all keys (depressed keys represented by key data KTDM) are assigned to certain ones of all channels ch1 through ch10. (see UK assignment of $\overline{\text{ABC}}$ in FIG. 3*c*).

The row FC shown in FIG. 3*c* outlines the processing executed when a fingered code mode is selected as the automtic performance mode. The row SF shows the outline of the processing when the single finger mode is selected. With either one of the single fingered code mode FC and the single finger mode SF, at the times of scanning (signals BT0 through BT3) the keys C7 through C#3 of the melody key range UK, the depressed keys in the melody key range UK represented by the key data KTDM are assigned to the melody musical tone production channels ch7 through ch10 (see UK assignment of FC and SF shown in FIG. 3*c*).

The the fingered code mode FC, since the depressed key notes of the keys in the accompaniment key range LK are utilized as the chord constituting notes as they are, at the times of scanning the keys C3 through C2 (at the times of generatig signals BT4 and BT5) in the accompaniment key range LK, the depressed keys in the accompaniment key range LK represented by the key data KTDM are assigned to the chord musical tone generating channels ch1 through ch4 (see LK assignment shown in FIG. 3*c*). At this time the key data KTD of the keys C3 through C2 in the accompaniment key range LK is stored in a shift register 54, and at the time of generating signals BT6 and BT7, the root note of the chord is detected based on the accompaniment key range data stored in the shift register 54 (see root note detection shown in FIG. 3*c*). When the next scanning cycle signal BT0 is generated, the bass tone data formed in accordance with the detected root note is assigned to the base musical tone generating channel ch6 (see PT assignment shown in FIG. 3*c*). Further, the data regarding an automatic arpeggio is assigned to the channel ch5 (see AK assignment shown in FIG. 3*c*).

In the single finger mode SF, the accompaniment key range LK is not used to designate a chord constituting note but instead to designate the root note of a chord, so that at the timings of scanning (at the times of generating signals BT4 and BT5) of the accompaniment key range LK, no tone production processing is performed but the highest depressed key in the accompaniment key range LK is detected (see LK highest note detection in FIG. 3*c*). In this example, in the case of the single finger mode, a root note designation key is depressed as the highest depressed key in the accompniment key range. When the signal BT7 is generated, a chord constituting note automatically formed according to the note name of the detected highest depressed key, that is the root note name is assigned to the chord musical tone production channels ch1 through ch4 (see SF chord assignment shown in FIG. 3*c*). At the time of generating a signal BT0 for the next scanning time, the bass (PK assignment) and the arpeggio (AK assignment) are asigned in the same manner as in the fingered code mode FC.

The circuits used to the tone production assignment circuit 51, the window circuit 52, a truncate circuit 55, a key code memory device 56, a comparator 57 and an octave code converting circuit 58. The key code memory device 56 comprises a circulating type shift register (not shown) having 11 stages corresponding to 11 channel timings for storing key codes KC* assigned to respective channels ch1 through ch10 and outputs the key codes, on the time divisioned basis, according to the system clock pulse $\phi$. The note code NC among key codes KC outputted from the scanning counter 49 is inputted into the key code memory device 56 as it is, while the octave code OC is applied to the key code memory device 56 via the octave code converting circuit 58 which is provided to form an octave code (OC') of the chord constituting tone in the single finger mode SF, or an octave code (OC'') of a bass tone or an octave code (OC''') of an arpeggio tone.

The output key code KC of the scanning counter 49 represents a key now being scanned, that is a key corresponding to a time divisioned and multiplexed key data KTDM. The comparator 57 compares key codes KC* outputted from the key code memory device 56 and have already been assigned to respective channels with key codes KC applied to the input of the key code memory device 56, and produces a coincidence signal when compared key codes coincide with each other.

The assignment circuit 51 executes one assignment processing during an interval (22 bit times) corresponding to one period of the clock pulse $\phi$A generated by the key data KTDM. Accordingly, in one assignment processing the channel timings circulate twice (see FIG. 3*a*). During the fore half 11 bit times of one assignment processing period, the clock pulse $\phi$A becomes "1", while during the latter half 11 bit times, the clock pulse $\phi$B becomes "1". These clock pulse $\phi$A and $\phi$B and the channel timing signals UchT, LchT, AchT and PchT (see FIG. 3*a*) control the operation of the assignment circuit 51.

The depressed key assignment operation in the melody key range UK will firstly be described. The time divisioned and multiplexed key data KTDM produced by the key scanning circuit 48 are applied to one inputs of AND gate circuits 59, 60 and 61. To the other input of the AND gate circuit 59 is applied the output of the NAND gate circuit 53 as above described, while to the other inputs of the AND gate circuits 60 and 61 is applied the accompaniment key range scanning timing signal LKT (see FIG. 3*c*). Accordingly, only the AND gate circuit 59 is enabled while the key data KTDM in the melody key range UK are being outputted and the other AND gate circuits 60 and 61 are not enabled, whereby the AND gate circuit 59 produces key data KU for the melody key range. The key data KU for the melody key range are applied to the assignment circuit 51.

The assignment circuit 51 executes the assignment to the melody musical tone production channels (channels ch7 through ch10 in the automatic bass chord mode, whereas ch1 through ch10 in the normal mode) in accordance with the key data for the melody key range. The assignment circuit 51 stores a coincidence signal EQ outputted from the comparator 57 when the clock pulse $\phi$A is "1" (the fore half assignment processing period) and holds this coincidence signal during the latter half assignment processing period (11 bit times in which the clock pulse $\phi$B is "1"). The stored coincidence signal EQ is designated by a signal EQM which is "1" when the coincidence signal EQ is generated but "0" when the coincidence signal is not produced (non-coincidence). The assignment circuit 51 is supplied with truncate channel designation signals TRU and TRL from the truncate circuit 55. The truncate circuit 55 detects a channel which become depressed state at the first time in the melody channels (channels ch7 through ch10 in the automatic bass chord note, whereas in the normal mode, channels ch1 through ch10) for generating a melody truncate channel designation signal TRU corresponding to the timing of the detected channel. Furthermore, the truncate circuit 55 detects a channel which become a released key state for the first time in the chord channels (ch1 through ch4 in the automatic bass chord mode) for producing a chord truncate channel designation signal TRL corresponding to the timing of the detected channel. The assignment circuit 51 is provided with a key-on memory device 62 which produces, on the time division basis, a key-on signal KON representing whether keys corresponding to the key codes KC* assigned to respective channels ch1 through ch10 are now being depressed or released. The key-on signal KON is "1" when the key is being depressed and "0" when the key is released.

The assignment circuit 51 produces a load signal LD when the following logic condition is satisfied in connection with the melody key data KU (i.e., KU, $\overline{\text{EQM}}$, $\phi$B, $\overline{\text{KON}}$, TRU and UchT are all "1"). Thus $$\text{LD} = \text{KU}\cdot\overline{\text{EQM}}\cdot\phi\text{B}\cdot\overline{\text{KON}}\cdot\text{TRU}\cdot\text{UchT} \quad (1)$$

The melody key data KU of "1" means that the key code KC applied to the key code memory device 56 from the scanning counter 49 in synchronism with the key data KU corresponds to a depressed key. The signal $\overline{\text{EQM}}$ obtained by inverting the coincidence signal EQM of "1" means that no coincidence signal EQ was produced, that is the depressed key codes KC corresponding to the key data KU have not yet been assigned to any tone production channel and hence the key codes should be newly assigned to same ones of the melody channels. The clock pulse $\phi$B of "1" means a latter half assignment processing period, that is the signal $\overline{\text{EQM}}$ is a correct one. A signal $\overline{\text{KON}}$, an inversion of the key-on signal KON, of "1" means channel timings at which the keys are in released states. A melody truncate channel designation signal TRU of "1" means a channel timing in which keys are firstly released, that is a channel from which the oldest tone production assignment should be erased to permit a new assignment. A melody channel timing signal UchT of "1" means a melody channel timing (see FIG. 3*a*).

When the condition of equation (1) is satisfied, a load signal LD is produced once for each channel timing of the melody channel, and this load signal LD is applied to the load control input L of the key code memory device 56 in which a key code KC given from the scanning counter 49 is substituted for the old key code KC* stored in a channel which has generated the load signal LD. In the key-on memory device 62, a key-on signal KON corresponding to a channel which has generated the load signal LD is set to "1".

The melody channel key-on signal KON stored in the key-on memory device 62 is reset to "0" when the following condition is satisfied.

$$\overline{KU}\cdot EQ\cdot UchT\cdot KON \rightarrow KON \text{ reset} \quad (2)$$

A signal $\overline{KU}$, an inversion of the melody key data, of "1" means that keys corresponding to the key codes KC given from the scanning counter 49 have been released. A coincidence signal EQ and a signal UchT are both "1" means that the same key codes KC* as the key codes KC for the released keys have been assigned to the melody channels. The key-on signal KON of "1" shows that the keys assigned to the melody channels in which the coincidence signal EQ has been produced have been depressed immediately before. Accordingly, the key-on signals corresponding to the channel timing that satisfies the condition of equation (2) would be reset to "0".

The assignment processing of the chord channels in the fingered code mode FC of the automatic bass chord mode will be described hereunder. When the fingered code mode (FC) is selected, the fingered code mode signal FC becomes "1", whereas the single finger mode signal SF becomes "0" and is applied to one input of the AND gate circuit 60. Consequently, in the fingered code mode FC, key data KTDM of the keys C3 through C2 in the accompaniment key range would be selected by the AND gate circuit 60 based on the accompaniment key range scanning timing signal LKT (see FIG. 3*c*) and the selected key data are applied to the assignment circuit 51 as chord key data KL via an OR gate circuit 63. The output of an AND gate circuit 64 applied to the other input of the OR gate circuit 63 is brought to "0" by the "0" state of the single fingered mode signal SF.

When the following logic condition (KL, $\overline{EQM}$, $\phi$B, $\overline{KON}$, TRL and LchT are all "1") regarding the chord key data KL is satisfied, the assignment cirucit 51 produces a load signal LD.

$$LD\cdot KL\cdot\overline{EQM}\cdot\phi B\cdot\overline{KON}\cdot TRL\cdot LchT \quad (3)$$

Equation (3) is different from equation (1) in that a chord truncate channel designation signal TRL and a chord channel timing signal LchT (see FIG. 3*a*) are utilized with reference to the chord key data KL, but equation (3) has the same meaning as equation (1). The processing (application of the key codes KC to the key code memory device 56 as well as the storing of the key-on signal KON) at the time of generation of the load signal LD is also similar to that described above. The condition of resetting to "0" the key-on signals KON for the chord channels (ch1 through ch4) is as follows:

$$\overline{KL}\cdot EQ\cdot LchT\cdot KON \rightarrow KON \text{ reset} \quad (4)$$

Equation (4) has substantially the same meaning as equation (2).

The tone production assignment to the bass channel (ch6) in the fingered code mode FC will not be described. AND gate circuit 61 selects only the key data LKTDM in the accompaniment key range (keys C3 through C2) among the time divisioned multiplexed key data KTDM based on the accompaniment key range scanning timing signal LKTDM (FIG. 3*c*). This accompaniment key data LKTDM is received by the 12 stage/1 bit shift register 54 which is controlled by the clock pulse $\phi$A in synchronism with the key scanning timing and its 12th stage output Q12 is returned to the first stage Q1, thus circulating through the shift register 54. The outputs of respective stages of the shift register 54 are inputted in parallel to a root note detection memory device (ROM) 65.

When 12 key data LKTDM corresponding to the keys C3 through C#2 in the accompaniment key range are applied to respective stages of the shift register 54, the 12th stage Q12 outputs key data (which is "1" when the key C3 is depressed, but "0" when the key C3 is not depressed) of the highest note key C3 in the accompaniment key range, whereas the 11th stage Q11 outputs the key data of keys B2 through C#2. At this time, the AND gate circuit 61 selects and outputs the key data LKTDM of the lowermost key C2 and the selected data is applied to the first stage Q1 of the shift register 54. At the same time the first stage Q1 thereof is applied with the key data of key C3 from the 12th stage Q12. As the data of respective stages are shifted to the next stages at the next shift timing, the first stage Q1 is supplied with the key data (that is the debressed key data of the note name C) of the key C2 or C3. As above described, the key data LKTDM of keys C3 through C2 in the accompaniment key range are converted into 12 note data corresponding to their note names C, B, A . . . C# and these note data are circulated and held in the shift register 54. The note name of the note data outputted from the 12th stage Q12 of the shift register 54 corresponds to the note name of the note code NC outputted from the note counter 49A. Because, the same note timing (see FIG. 3*b*) is repeated at every 12 periods of the clock pulse $\phi$A. For this reason, the output of the 12th stage Q12 obtained by delaying the key data LKTDM by 12 periods of the clock pulse $\phi$A coincides with the note timing of key scanning.

The root note detection ROM 65 is supplied with 12 note data from respective stages of the shift register 54 as address inputs, and based on a combination of the values ("1" and "0") of these base data, the ROM 65 judges whether a chord is established or not. When the chord is established, the ROM 65 produces an output "1", whereas when the chord is not established, the ROM 65 produces "1" at the time of the highest tone pitch. Of course, the note data of a depressed key is "0" and that of a not depressed key is "0". In the root note detection ROM 65 the note data outputted from the 12th stage Q12 of the shift register 54 is deemed as a one degree note (1), and those outputted from the first to the 11 stages are deemed as a minor 2 degree note 2*b* through major 7 degree note (7)so as to judge whether the note data in the shift register 54 is "1" or "0" with an interval that satisfies a condition of establishing a predetermined chord. As the note data in the shift register 54 are sequentially shifted, the root name detection ROM 65 sequentially changes the note name of the one degree note (1) to check whether a chord is held or not.

Application of the note data of keys C3 through C2 in the accompaniment key range into the shift register 54 is completed by the signal BT5 (see FIG. 3*c*) and at the next signal BT6, the note data of all depressed keys in the accompaniment key range are positively held in the shift register 54. Since 12 note data circulate once through the shift register 54 at 12 note timings at which signal BT6 is generated, the judgement made by the root note detection ROM 65 as to whether a chord is established or not complete perfectly. As a consequence, when the root note detection ROM 65 does not detect the establishment of a chord at the time of generating signal BT6. The ROM 65 produces an output "1" corresponding to the note timing of the highest note depressed key in the accompaniment key range at the time of generating the next signal BT7, so as to use the highest note depressed key as aquasi root note. Since the note data circulate through the shift register 54 according to the order of C, B, A# . . . C# the time at which signal "1" firstly arrives at the 12th stage Q12 of the shift register 54 at the time of generating signal BT7 is the note timing of the highest note depressed key, and the root note detection ROM 65 outputs "1" at that time. Of course, the chord is established at the time of generating signal BT6. When ROM 65 produces "1" at the note timing representing the root note of the chlord above described, temporary root note selection processing would not be executed at the time of generating signal BT7.

A signal "1" corresponding to the note timing of a root note outputted from the root note detection ROM 65 at the time of generating signal BT6 or BT7 is applied to one input of an AND gate circuit 66 with its other input connected to receive a fingered chord mode signal FC and a signal (BT6+BT7) formed by logically adding the signals BT6 and BT7. Consequently, data "1" corresponding to the note timing of the root note outputted from the root note detection ROM 65 at the time (BT6+BT7 is "1") of generating signal BT6 or BT7 in the fingered code mode (FC is "1"), passes through the AND gate circuit 66 and then applied to a root note shift register 68 via an OR gate circuit 67. The note data held in the shift register 54 are all cleared by a signal BT3 immediately prior to the accompaniment key range scanning timing in the next scanning cycle.

The root note shift register 68 comprises a 12 stage-/one bit circulating type shift register which s shift controlled by the clock pulse $\phi$A. In the root note shift register 68, a single signal "1" received at the note timing of the root note (or the quasi note) is sequentially shifted, circulated and held. Thus the first stage Q1 of the root note shift register 68 produces "1", at a note timing of a note a semitone lower (major 7 degree note) than the root note, while the second stage produces "1" at the note timing of a note 2 semitones lower than the root note (minor 7 degree note). In the same manner, the third Q3 through 12 stages Q12 respectively produce "1" at the note timings of the major 6 degree note through one degree note (root note). Thus, respective stages of the root note shift register 68 correspond to respective interval degrees. The root note shift register 68 is constructed to clear signal "1" stored therein (old root note data) when signal "1" is applied thereto from the OR gate circuit 67.

The outputs of respective stages of the root note shift register 68 are parllelly inputted to a bass key data forming circuit 69 and a SF chord key data forming circuit 70. Bass pattern data generated by a rhythm pattern generator 71 is decoded by a decoder 72 and then applied to the bass note key data forming circuit 69. The bass pattern data BP is generated at the time of generating a bass and constituted by a code signal representing the interval degrees (an interval for the root note such as 1 or 3 degrees) of the bass to be produced. The bass note key data forming circuit 69 selects an output of a stage corresponding to the bass note degrees decoded by a decoder 72 among the outputs of respective stages of the root note shift register 68 and supplies the selected output to one input of an AND gate circuit 73, the other input thereof being supplied with signal BT0. Since theroot note data is taken into the root note shift register 68 by the timing action of signal BT6 or BT7 at the time of generating the next signal BT0, data "0" circulates once through the root note shift register 68. Consequently, by enabling AND gate circuit 73 with the signal BT0, it is possible to derive correct data from the bass note key data forming circuit 69. The output of the AND gate circuit 73 is applied to the asignment circuit 51 as a bass note key data KP which becomes "1" at the note timing of a tone name corresponding to the interval degrees designated by the bass pattern data BP.

When the bass note key data KP becomes "1", the note code NC outputted from the note counter 49A represents the note name of the bass designated by the bass note key data KP. At this time, the octave code converting circuit 58 produces an octave code OC″ for the bass at the bass production channel timing. An AND gate circuit 74 is supplied with the signal BT0 and the bass channel timing signal PchT (see FIG. 3*a*) so that its output becomes "1" at the time of generating the signal BT0 at which the bass note key data KP is produced and at the bass note channel timing. As the output of the AND gate circuit 74 becomes "1", the octave code converting circuit 58 converts the value of the octave code OC to the octave code OC″ representing the octave range of a bass. As a consequence, the key code applied to the key code memory device 56 and the comparator 57 is constituted by a combination of a note code NC and an octave code OC″ and represents a bass corresponding to the bass note key data KP.

The assignment circuit 51 produces a load signal LD when the following logic condition is satisfied with reference to the bass note key data KP.

$$LD = KP \cdot \phi B \cdot PchT \quad (5)$$

In other words, when the bass note key data KP becomes "1", the load signal LD is produced at the channel timing (PchT is "1") for the bass during the latter half assignment processing period ($\phi$B is "1"). Based on this load signal LD, a key code for a bass, which comprises a note code NC and an octave code OC″ is stored in the key code memory device 56, and a key-on signal KON is stored in the key-on memory device 62.

The processing in the single finger mode SF will now be described. Where the single finger mode is slected, the fingered code mode signal FC is "0", while the single finger mode signal SF is "1". As a consequence, signal FC of "0" disenables the AND gate circuit 60 so that the key data KTDM of the actually depressed keys in the accompaniment key range are not used as the chord key data. Further, signal FC of "0" also disenables the AND gate circuit 66 so that the output of the root note detection ROM 65 is not utilized.

The key data in the accompaniment key range selected by the AND gate circuit 61 is applied to a SF highest note detection circuit 75 which detects the highest note depressed key in the accompaniment key range as a root note designation key in the single finger mode SF. With the time divisioned and multiplexed accompaniment key range key data LKTDM, since the data of respective keys C3 through C2 appear in the order of tone pitches at the times of generating signal BT4 and BT4, an instant at which data "1" appears firstly corresponds to the scanning timing of the highest note depressed key in the accompaniment key range. For this reason, the SF highest note detection circuit 75 preferentially selects data "1" which has arrived firstly among the time divisioned and multiplexed key data LKTDM and applies the selected signal "1" to one input of an AND gate circuit 76 as the root note designation key data SFRT. Further, the SF highest note detection circuit 75 stores the fact that the root note designation key data SFRT has been preferentially selected for blocking succeeding key data LKTDM (on the lower note side than the highest note) based on this stored data. This stored data is cleared at the time of generating signal BT3 in the next scanning cycle.

A logic sum (BT4+BT5) of signals BT4 and BT5, and the single finger mode signal SF are applied to the other inputs of the AND gate circuit 76 and its output is applied to a root note shift register 68 via the OR gate circuit 67. Consequently, in the single finger mode (SF is "1"), signal "1" is taken into the root note shift register 68 when the root note designation key data SFRT becomes "1". In the same manner as above described, a single data "1" circulates through the root note shift register 68 so that the stages of the shift register corresponding to degrees, 7, $7^b$ . . . $2^b$ and 1 sequentially produce "1" at a timing determined by the root note designation data SFRT. For example, when the root note designation data SFRT becomes "1" at the note timing of the note name C, the first stage Q1 of the shift register 68 corresponding to the major seven degrees 7 produces "1" at the note timing of the note name B.

A SF chord key data forming circuit 70 selects the output of a predetermined stage of the root note shift register 68 in accordance with a minor chord selection signal min and a seventh chord selection signal 7th and applies the selected output to one input of an AND gate circuit 64. The chord selection signal min and 7th selected and designate the type of the chord in the single finger mode. A state in which these signals are both "0" represents a major chord, while a state in which signal min is "1" represents a minor chord. Signal 7th of "1" represents the seventh chord. These chord selection signals min and 7th may be produced by selectively operating a chord type selection switch, not shown, or may be produced by selectively depressing a natural (white) key and a sharp (black) key by the keyboard. The SF chord key data forming circuit 70 selects and multiplexes the outputs of the 12th stage, 8th stage and 5th stage of the root note shift register 68 respectively corresponding to 1 degree, major 3 degrees and perfect five degrees in the case of the major chord (min and 7th are both "0" and supplies the multiplexed outputs to one input of the AND gate circuit 64. In the case of the minor chord (min is "1"), the SF chord key data forming circuit 70 selects the output of the 9th stage corresponding to the minor 3 degrees instead of the output of the 8th stage corresponding to the major 3 degrees. In the case of the seventh chord (7th is "1"), the SF key data forming circuit 70 selects the output of the second stage corresponding to the minor 7 degrees instead of the output of the 5th stage corresponding to the perfect 5 degrees.

To the other inputs of the AND gate circuit 64 are applied the signal BT7 and the single finger mode signal SF. Consequently, the multiplexed key data of respective chord constituting notes for the single finger mode outputted from the SF chord key data forming circuit 70 pass through the AND gate circuit 64 at the time of generating signal BT7 (see FIG. 3*c*) in the single finger mode (SF is "1")and then supplied to the assigning circuit 51 as the chord key data KL via the OR gate circuit 63.

The assigning circuit 51 assigns the chord key data KL under the condition shown in equation (3). As above described, in the single finger mode, since the chord key data KL are generated by the timing action of signal BT7, the content of the octave chord DC outputted from the octave counter 49B at that time does not correspond to the actual keyboard note range. For this reason, the octave code converting circuit 58 is provided for the purpose of converting the octave chord OC into an octave code OC′ representing a predetermined octave note range for a chord. More particularly, the single finger mode signal SF and the signal BT7 are applied to an AND gate circuit 77 and when the output hereof is "1" (that is when the AND gate circuit 64 is enabled to produce a chord key data for the single finger mode), the octave code converter 58 converts the octave code OC into the chord octave code OC′. As a consequence, when an assigning condition for a key data KL generated at a note timing is satisfied to generate a load signal LD, a key code KC consisting of a combination of a note code NC representing the note means of the key data of the load signal LD and a chord octave code OC′ is stored in the key code memory device 56. It should be understood that equation (4) is not applicable to the resetting of the key-on signal KON of the chord channel in the single finger mode and that the key-on signal KON of the chord is reset when all key in the accompaniment key range are released.

The base note key data forming processing and their note production assignment processing in the single finger mode are the same as those in the fingered code mode (FC) described above.

An arpeggio key data forming circuit 78 includes a shift register, not shown, that stores the note timings of respective key data of the accomapniment chord constituting notes in the finger code mode FC or the single finger mode SF so as to search a note of the tone pitch order designated by an arpeggio pattern data ARP out of the key data (note data) of the chord constituting notes stored in the shift register and applies to one input of an AND gate circuit 79 corresponding to the note timing of the searched note name. The other input of the AND gate circuit 79 is supplied with a signal BT0 so that the output of the arpeggio key data forming circuit 78 passes through the AND gate circuit 79 and enters into the assigning circuit 51 as the arpeggio key data KA which becomes "1" corresponding to the note timing of the arpeggio. An AND gate circuit 80 connected to the octave code converting circuit 58 is supplied with a signal BT0 and an arpeggio note channel timing signal AchT (see FIG. 3*a*) so that the AND gate circuit 80 produces "1" when the signal BT0 is generated t the arpeggio channel timing.

When the output of the AND gate circuit 80 is "1", the octave code converting circuit 58 produces an octave code OC‴ representing an octave range for the arpeggio instead of the octave code OC. Consequently, the key code KC inputted to the key code memory device 56 at the time of generating the arpeggio key data KA comprises a combination of the note code NC and the octave code OC‴ which represents the tone pitch of the arpeggio corresponding to the key data KA. The assigning circuit 51 produces a load signal LD when the following logic condition is satisfied with reference to the arpeggio key data KA.

$$LD = KA \cdot \phi B \cdot AchT \quad (6)$$

Thus, when the arpeggio key data KA becomes "1", the load signal LD would be produced at the arpeggio channel timing (AchT is "1") during the latter half assignment processing period ($\phi$B is "1"). In response to this load signal LD, the arpeggio key code KC comprising the note code NC and the octave code OC''' is stored in the key code memory device 56 while a key-on signal KON is stored in the key-on memory device 62.

As above described, a key codes KC* assigned to respective channels ch1 through ch10 are stored in the key code memory device 56, while key-on signals KON corresponding to respective channels are stored in the key-on memory device 62. The key codes KC* and key-on signals KON of respective channels outputting from the key code memory device 56 and the key-on memory device 62, on the time division basis, at the channel timings shown in FIG. 3*a* are applied to the data multiplexer 17 to be multiplexed into 4 bit data KD1 through KD4. Further, the data multiplexer 17 is supplied with a chord channel timing signal LchT, a chord tone producing timing pattern pulse CT and the automatic bass chord mode signal ABC generated by a rhythm pattern generating circuit 71 for shaping a key-on signal KON (that is a chord key-on signal KON) produced corresponding to the chord channel timing signal LchT to have the same width as that of the chord tone producing timing pattern pulse CT (that is the key-on signal KON of the chord channel is chopped by the pulse CT).

Figures 4, 8:
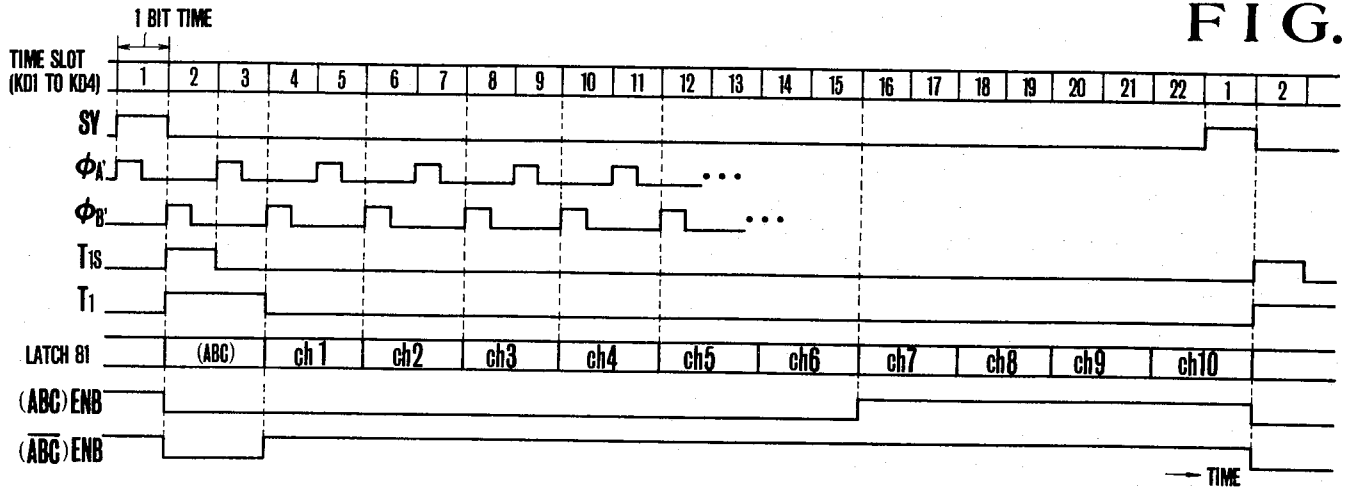
FIG. 4 is a chart showing one cycle of the contents of respective time divisioned time slots of the multiplexed data outputted from the data multiplexer shown in FIG. 2.
FIG. 8 is a timing chart showing one example of producing output signals of various parts.

One example of the states of the multiplexed data KD1 through KD4 outputted from the data multiplexer 17 is shown in FIG. 4. One cycle of each data comprises 22 time slots. In the row "time slot" shown in FIG. 4, numbers [1] through [22] are shown according to the order of generation of the time slots. The width of each time slot is equal to one bit time of the system clock pulse $\phi$. Consequently, one repetition cycle of each data comprises 22 bit times which are the same as one tone production assignment processing period. In the row "channel timing" shown in FIG. 4, are shown the time divisioned channel timings [2] through [11] (see FIG. 3*a*) of the assigning circut 51 and the key code memory device 56. These row are provided for the purpoe of explaining the time slots in which the key codes KC* (note codes N1 through N4 and octave code B1 through B4) inputted to the data multiplexer 17 at the channel timings [2] through [11] and the key-on signal KON are multiplexed into data KD1 through KD4. The row "channel timing" shows musical tone production channels ch1 through ch10 corresponding to these channel timings. The row ABC shows that all channels ch1 through ch10 act as melody channels U in the normal mode, while row "$\overline{\text{ABC}}$" shows that channels ch1 through ch10 correspond to either ones of the chord channels L, arpeggio channels A, bass channels P and melody channels U.

In time slot [1] not corresponding to a musical tone production channel data KD1 through KD4 are all "1", thus showing the reference timing, that is the time slot [1] of data KD1 through KD4. In time slot [2], a state "1" or "0" of the automatic bass chord mode signal ABC is sent out as data KD2. In time slots [3] through [22] corresponding to the musical tone production channels ch1 through ch10, two time slots are assigned to each channel. The first time slots [3], [5]. . . [21] of each channel produce octave codes B1 through B3 and key-on signal KON assigned to that channel as data KD1 through KD4 and the next time slots [4], [6]. . . [>] produce note codes N1 through N4 of a note assigned to that channel as the data KD1 through KD4.

Melody Highest Note Detector

Figure 5:
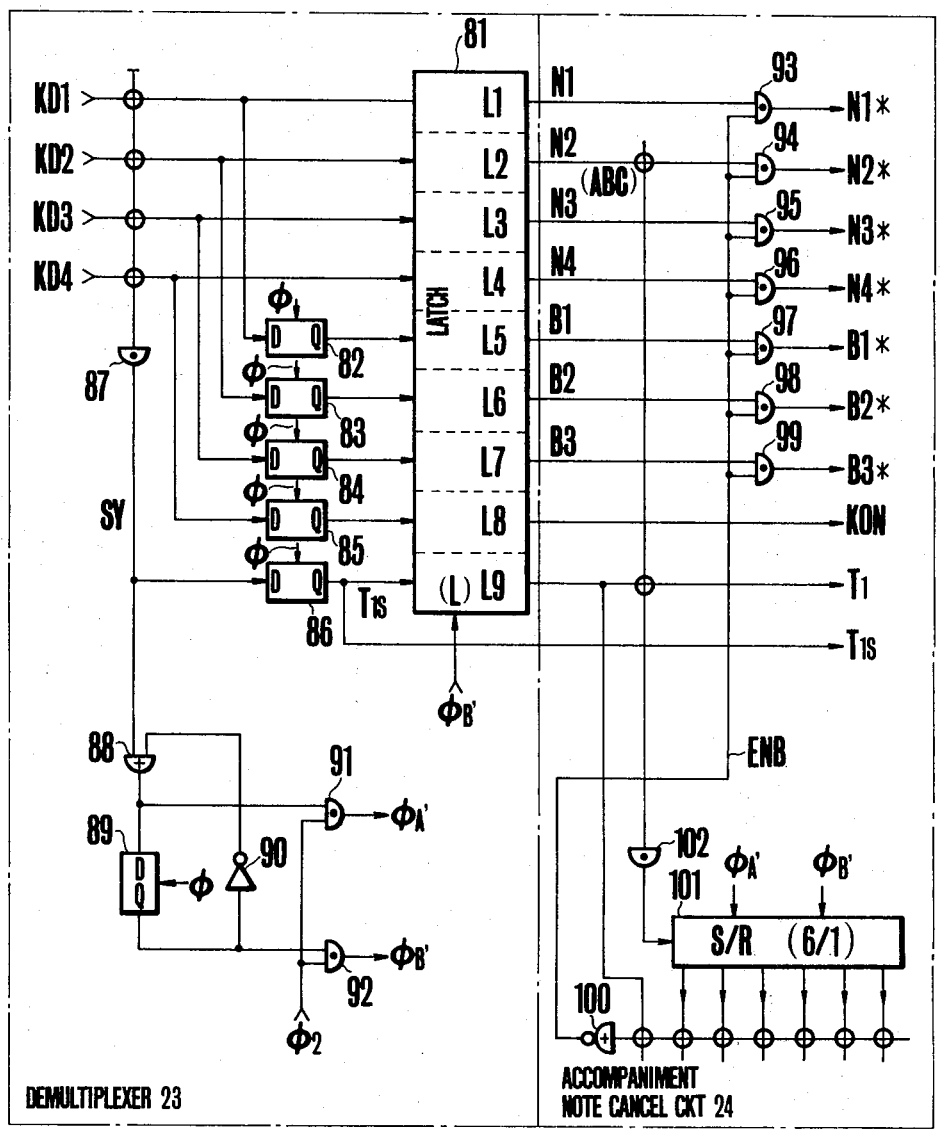
FIG. 5 is a connection diagram showing one examples of the data demutliplexer and the accompaniment tone cancel circuit shown in FIG. 1.
Figure 6:
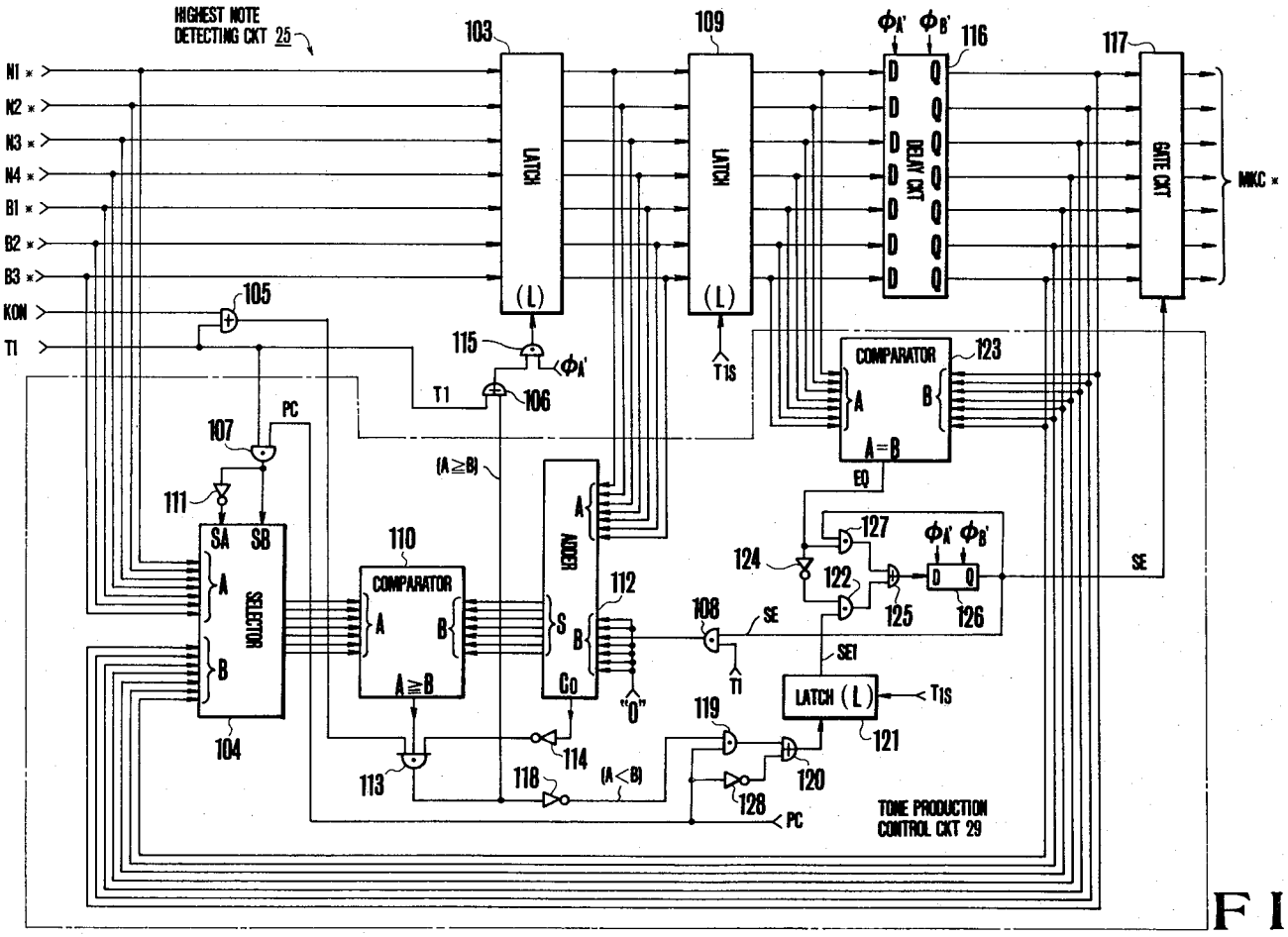
FIG. 6 is a block diagram showing one example of the highest note detection circuit shown in FIG. 1.
Figure 7:
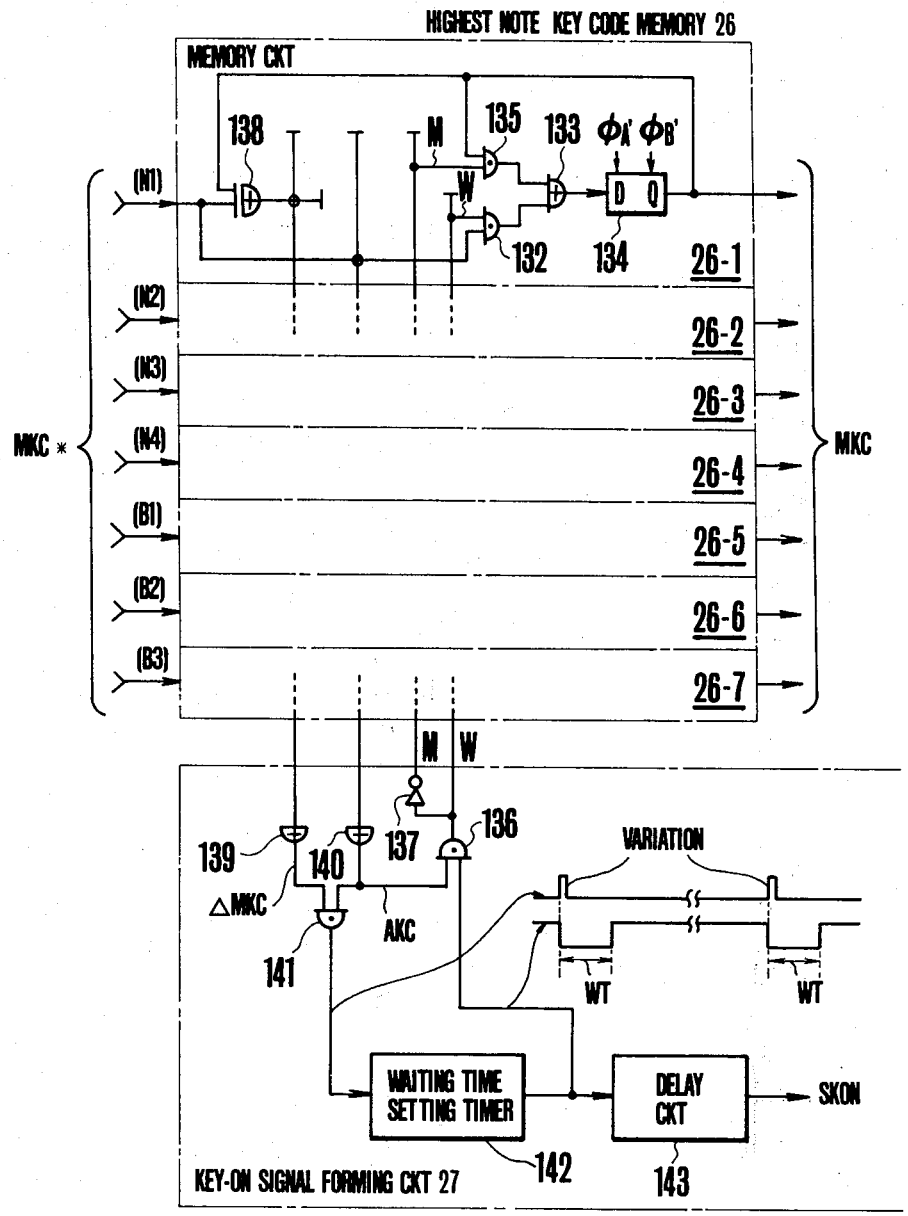
FIG. 7 is a block diagram showing one examples of the highest note key code memory device and the key-on signal forming circuit shown in FIG. 1.

The details of the data demultiplexer 23 and the accompaniment note cancel circuit 24 of the melody highest note detector 21 are shown in FIG. 5, the detail of the highest note detection circuit 5 is shown in FIG. 6, and those of the highest note key code memory device 26 and the key-on signal forming circuit 27 are shown in FIG. 7.

In FIG. 5, 4 bit multiplexed data KD1 through KD4 are inputted into the latch positions L1 through L4 of a latch circuit 81 of the data demultiplexer 23 and are delayed one bit times respectively by delay flip-flop circuits 82, 83, 84 and 85 and then inputted to latch positions L5 through L8 respectively of the latch circuit 81. All bits of the data KD1 through KD4 are inputted to an AND gate circuit 87. When data KD1 through KD4 all become "1" at the time slot [1] (see FIG. 4), the output of the AND gate circuit 87 becomes "1" which is applied to an OR gate circuit 88 as a reference pulse SY representing the time slot [1] and the a delay flip-flop circuit 86.

The output of the OR gate circuit 88 is applied to a delay flip-flop circuit 87, and the output thereof is returned to the OR gate circuit 88 after being inverted by an inverter 90. The delay flip-flop circuit 89 is controlled by the system clock pulse $\phi$. The output of the OR gate circuit 88 becomes "1" during one bit time (time slot [1]) in which the reference pulse SY is generated, but becomes "0" during the next one bit time (time slot [2]) in which the output of the delay flip-flop circuit 89 is "1". During the next bit time (time slot [3]), the output of the delay flip-flop circuit 89 is "0" and the output of the OR gate circuit 88 becomes "1". As above described the OR gate circuit 88 and the delay flip-flop circuit 89 alternately produce "1" at each bit time. The output of the OR gate circuit 88 is applied to one input of an AND gate circuit 91, while the output of the delay flip-flop circuit 89 is applied to one input of an AND gate circuit 92. The other inputs of the AND gate circuits 91 and 92 are supplied with a clock pulse $\phi$2 having the same period as the system clock pulse $\phi$ and changing to "1" in the fore half of one bit time. Actually, the system clock pulse $\phi$ comprises two phase clock pulses, one of them being the clock pulse $\phi$2. Consequently, the AND gate circuits 91 and 92 produce timing pulses $\phi$A' and $\phi$B' as shown in FIG. 8 which also shows time slots [1] through [22] of the data KD1 through KD4 (see FIG. 4) and the reference pulse SY.

The delay flip-flop circuit 86 produces a pulse $T_{1s}$ obtained by delaying one bit time the reference pulse SY. As shown in FIG. 8, the pulse $T_{1s}$ becomes "1" corresponding to the time slots [2] of data KD1 through KD4. This pulse $T_{1s}$ is applied to the latch position L9 of a latch circuit 81. The timing pulse $\phi$B' outputted from the AND gate circuit 92 is applied to the control input L of the latch circuit 81. Thus, the latch circuit 81 latches input data in each one of the even numbered time slots [2], [4], [6] . . . [22]. The data KD1, KD3 and KD4 latched at latch positions L1, L3 and L4 of the latch circuit 81 at the time slot [2] are all "0", while the data KD2 latched at the latch position L2 is the mode signal ABC (see FIG. 4). The data latched at the latch positions L5 through L8 are the data KD1 through KD4 (that is "1111") at the slot time [1]. The pulse $T_{1s}$ (that is "1") is latched at the latch position L9 at the time slot [2]. The data latched at the latch positions L, L3, L4 L5, L6, L7 and L8 at the time slot 2 are of no use so that they are erased at the next latch timing (time slot [4]) without being utilized. The mode signal ABC and the pulse $T_{1s}$ (that is "1") latched at the latch positions L2 and L9 at the time slot [2] are presenced until erased at the next latch timing (time slot [4]), that is during an interval between time slots [2] and [3], and utilized by the accompaniment circuit 24 during this interval. As shown in FIG. 8, the timing signal $T_1$ outputted for the latch position L9 of the latch circuit 81 is "1" only during an interval between time slots [2] and [3].

The latch operation of the latch circuit 81 after time slot [4] is as follows: Thus, since the data are latched at the even numbered time slots [4], [6] . . . [22], the note codes N1 through N4 sent out as the data KD1 through KD4 at that time, the octave codes B1 through B3 of the same channel one slot time before which have been delayed by the delay flip-flop circuits 82 through 85, and the key-on signal KON are simultaneously latched at the latch positions L1 through L8. Since the content of the latch circuit 81 is updated at every 2 bit times, the time width of the data N1 through N4, B1 through B3 and KON of the same channel which are outputted from the latch positions L1 through L8 of the latch circuit 81 are 2 bit times so that the channels of the data N1 through N4, N1 through B3 and KON are switched at every 2 bit times. The channels of the data N1 through N4, B1 through B3 and KON outputted from the respective latch positions of the latch circuit 81 are shown in a row "latch 81". As above described, the latch position L2 produces a mode signal ABC during an interval between time slots [2] and [3].

The accompaniment more cancel circuits 24 contains AND gate circuits 93 through 99 for cancelling the accompaniment note key codes (not codes N1 through N4 and octave code B1 through B3). One inputs of the AND gate circuits 93 through 99 are supplied with the outputs (that is bits N1 through B3 of the key code) of respective latch positions L1 through L7 of the latch circuit 81, while the other inputs are supplied with an enabling signal ENB via on NOR gate circuit 100 supplied with the outputs of all stages of the shift register 101 and the timing signal $T_1$ outputted from the latch circuit L9. At the time slots [2] and [3], since the timing signal $T_1$ is "1", the enabling signal ENB outputted from the NOR gate circuit 100 becomes "0" thus disabling AND gate circuits 93 through 99. Accordingly, useless data are prevented from being outputted from the latch positions L1 through L7 of the latch circuit 81 at the time slots [2] and [3].

The outputs from the latch positions L2 and L9 of the latch circuit 81 are applied to an AND gate circuit 102. When the timing signal $T_1$ outputted from the latch position L9 is "1", that is only at the time slots [2] and [3] the AND gate circuit 102 is enabled. At this time, the mode signal ABC is produced from the latch position L2. In other words, when the mode signal ABC is "1", that is in the automatic bass chord mode, the AND gate circuit 102 is enabled at the time slots [2] and [3] to produce an output "1" which is applied to a shift register 101 and shifted therethrough at every two bit times according to the timing pulses $\phi A'$ and $\phi B'$. The shift register 101 comprises 6 stages and operates to outputs from the first stage at time slots [4] and [5 data "1" received at the time slots [2] and [3 and to sequentially shift the data "1" at every 2 bit times (2 slot times). Accordingly, the data "1" is outputted from the last 6th stage at time since [14] and [15]. Since the outputs of all stages of the shift register 101 are applied to the NOR gate circuit 100, during an interval between time slots [4] through [15] in whch data "1" is sequentially outputted from respective stages, the enabling signal ENB outputted from the NOR gate circuit 100 is "0". As above described, at the time slots [2] and [3] too, the enabling signal ENB is "0", so that in the automatic bass chord mode (ABC is "1"), as shown in (ABC) ENB in FIG. 8, during an interval between time slots 2 and 15, the enabling signal ENB become "0".

The number 6 of the stages of shift register 101 corresponds to that of the accompaniment channels (ch1 through ch6) at the time of the automatic bass chord mode. The interval between the time slots [4] and [15] in which the enabling signal ENB becomes "0" while respective stages of the shift register 101 sequentially output "1", the latch positions L1 through L8 of the latch circuit 81 produce the key codes N1 through B3 and key-on signal KON regarding the accompaniment channels ch1 through ch6 as shown by a row "latch 81" in FIG. 8. Consequently, the AND gate circuits 93 through 99 which have been disabled by the enabling signal ENB of "0" block all key codes N1 through B3 of the accompaniment channels ch1 through ch6. After the time slot [16] in which the key codes N1 through B3 and the key-on signal KON of the melody channels ch7 through ch10 are outputted from the latch circuit 81, the enabling signal ENB becomes "1" so that the AND gate circuits 93 through 99 are enabled, so that only the key codes N1 through B3 of the melody channels ch7 through ch10 would be selected by the AND gate circuits 93 through 99.

In the normal mode, since the mode signal ABC is "0", at the time slots [2] and [3] in which the timing signal $T_1$ becomes "1", the AND gate circuit 102 would not be enabled. As a consequence, data "1" would not be taken into the shift register 101 so that respective stages thereof do not output "1". Thus as shown in a row $(\overline{ABC})$ENB in FIG. 8, the enabling signal ENB is "0" only at the time slots ∂2] and [3] and becomes "1" at and after the time slot [4]. In the normal mode, all channels ch1 through ch10 act as the melody channel so that the key codes N1 through B3 of all channels ch1 through ch10 outputted from the latch circuit 81 after the time slot [4] are selected by the AND gate circuit 93 through 99.

The key codes N1* through B3* of the melody channels selected by the AND gate circuits 93 through 99 are applied to the latch circuit 103 and an A input of a seletor 104 of the highest note detection circuit 25 shown in FIG. 6. The key-on signal KON outputted from the latch position L8 of the latch circuit 81 is supplied to one input of an OR gate circuit 105 shown in FIG. 6, while the timing signal $T_1$ outputted from the latch position L9 is applied to tone inputs of OR gate circuits 105 and 106 and AND gate circuit 107 and 108 shown in FIG. 6.

In the highest note detection circuit 25 shown in FIG. 6, the circuits that detect the highest note of a melody comprise latch circuits 103 and 109, a selector 104 and a comparator 110. Although the selector 104 and the comparator 110 are shown to belong to the tone production control circuit 29 (see FIG. 1) they are commonly used to detect a melody highest note and an interval between present and previous highest notes. The comparator 110 is used to detect the interval between present and previous highest notes at time slots

[2] and [3] in which the timing signal $T_1$ is generated (more particularly at the time slot [2] and time slot [4] and the following time slots are used for the detection of the melody highest note.

As first the highest note detection operation will be described. The highest note detection is effected by comparing with comparator 110 a key code latched in the latch circuit 103 with the key codes N1* through B3* of the melody channel (the channel timings are shown in the row "latch 81" in FIG. 8), which are supplied, on the time division basis, from the accompaniment cancel circuit 24 (FIG. 5) and then latching key codes having larger values (on the higher note side) in the latch circuit 103. The timing signal $T_1$ which becomes "1" at time slots [2] and [3] is supplied to one input of an AND gate circuit 115 via the OR gate circuit 106, so that the AND gate circuit 115 produces "1" at the time slot [3] in which the timing pulse $\phi A'$ (FIG. 8) becomes "1". The output "1" of the AND gate circuit 115 is applied to the load input L of the latch circuit 103. As above described, at this time slot [3], the AND gate circuits 93 through 99 (FIG. 5) of the accompaniment note cancel circuit 24 would not be enabled so that the data N1* through B3* applied to the latch circuit 103 are all "0". Thus, at the time slot [3], all "0" are latched in the latch circuit 103 so as to clear the content thereof. During an interval between the next time slot [4] and the time slot [1] of the next cycle, the timing signal $T_1$ is "0" during which the highest note is detected.

The timing signal $T_1$ is applied to one input of the AND gate circuit 107 so that when the signal $T_1$ is "0", the output of the AND gate circuit 107 is "0" and the output of an inverter 111 is "1", which is applied to the A selection control input SA of the selector 104. When a signal applied to the A selection control signal SA is "1", the selector 104 selects the key codes N1* through B3* inputted to the A input SA and applies the selected key codes to the A input of the comparator 110 with its B input supplied with the output S of an adder 112. The A input thereof is applied with the outputs of the latch circuit 103, while the B input is supplied with 7 bit data formed by synthesizing the output of an AND gate circuit 108 and a signal "0". Of the 7 bit data, the data at the third bit from the lowermost order is the output of the AND gate circuit 108, while the other bits are all "0". When the timing signal $T_1$ is "0", that is in an interval between the time slot [4] and the time slot [1] of the next cycle, the output of the AND gate circuit 108 is "0" so that the 7 bit data applied to the B input of the adder 112 are all "0". Accordingly, when the timing signal $T_1$ is "0", the data applied to the A input from the latch circuit 103 are outputted from the adder 112 as they are and applied to the B input of the comparator 110.

When A input and B input of the comparator 110 have a relation $A \geqq B$, the comparator 110 produces an output "1" which is applied to one input of AND gate circuit 113 with other inputs connected to receive the output of the OR gate circuit 105 and a signal obtained by inverting a carry signal Co produced by adder 112 with an inverter 114. As above described, in the case of the highest note detection operation, since adder 112 does not execute any addition operation, no carry signal Co would be produced so that the inverter 114 produces an output "1". Although the key-on signal KON and the timing signal $T_1$ are inputted to the OR gate circuit 105, since the highest note is detected when the timing signal $T_1$ is "0", at this time the timing signal $T_1$ is of no use with the result that the AND gate circuit 113 would be enabled when the key-on signal KON is "1".

Key-on signal KON of "1" means that keys corresponding to the key codes N1* through B3* of a melody which are applied concurrently with the key-on signal KON are now being depressed. Thus, where the key codes N1* through B3* applied to the A input of the comparator 110 via the A input of the selector 104 are larger than (higher notes) or equal to the key codes latched by the latch circuit 103 the output $A \geqq B$ of the comparator 110 becomes "1", and only when the keys corresponding to the key codes N1* through B3* are depressed, the output of the AND gate circuit 113 becomes "1" which is applied to one input of the AND gate circuit 115 via the OR gate circuit 106. The other input of the AND gate circuit 115 is supplied with the timing pulse $\phi A'$ (see FIG. 8), and the output of the AND gate circuit 115 is applied to the load control input L of the latch circuit 103. Consequently, as above described, when the output of AND gate circuit 113 becomes "1" due to the output $A \geqq B$ of the comparator 110, the AND gate circuit 115 produces "1" by the timing action of the timing pulse $\phi A'$ so that the key codes N1* through B3* that satisfy the condition $A \geqq B$ of the comparator 110 would be latched in the latch circuit 103.

As above described, the key codes N1* through B3* of the melody channels (channels ch1 through ch10 in the normal mode and channels ch7 through ch10 in the automatic bass chord mode) are sequentially compared with each other to latch the key codes having larger values (that is on the high note side) in the latch circuit 103. As above described in the normal mode, during an interval between time slot [4] and time slot [1] of the next cycle (see FIG. 8), the key codes N1* through B3* of the melody channels ch1 through ch10 are sequentially produced from the acompaniment note cancel circuit 24 (FIG. 5). In the automatic bass chord mode, during an interval between time slot [16] and the time slot [1] of the next cycle the key codes N1* through B3* of the melody channels ch7 through ch10 are sequentially outputted. In the time slot [2] next to the time slot [1] in which the comparison of the key codes N1* through B3* of the last channel ch10 with the content in the latch circuit 103 is made, the key code of the true melody highest note is positively latched in the latch circuit 103.

The output of the latch circuit 103 is applied to a latch circuit 109. To the load control input L of the latch circui 109 is applied a pulse $T_{1s}$ (see FIG. 8) which becomes "1" at the time slot [2], from the delay flip-flop circuit 86 shown in FIG. 5. As a consequence, the true highest key code latched by the latch circuit 103 is applied to the latch circuit 109. On the other hand, as above described, based on the timing signal $T_1$ which becomes "1" at the time slots [2] and [3] the output of the AND gate circuit 115 becomes "1" at the time slot 3, thus clearing the latch circuit 103. Accordingly, the highest note key code detected by the processing executed between time slot (4) of the preceding cycle and the time slot [1] is latched in the latch circuit 109 at time slot [2], and immediately thereafter the memory of the highest note key code in the latch circuit 103 is cleared.

Above described highest note detection operation is repeated for every one cycle (22 time slots) of the multiplexed key data KD1 through KD4. The highest note key code detected in each cycle is latched in the latch circuit 109 by the timing action of pulse $T_{1s}$ (time slot [2]) and the content of the latch circuit 109 is updated at each time. The highest note key code latched in the latch circuit 109 is applied to a delay circuit 116 and then outputted therefrom after being delayed 2 bit times by the 2 phase timing pulses $\phi A'$ and $\phi B'$ (FIG. 8). The highest note key code outputted from the delay circuit 116 is applied to a gate circuit 117 controlled by a tone production control signal SE applied from the tone production control circuit 29.

When the tone production control mode selection switch 28 (FIG. 1) is open (when the tone production control mode signal PC is "0"), the tone production control circuit 29 always makes "1" the tone production control signal SE for always enabling the gate circuit 117. When the tone production control mode selection switch 28 is closed (signal PC is "1"), a previously detected highest note key code is compared with a presently detected highest note key code at the time of producing the pulse $T_{1s}$ (see FIG. 8) and the tone production control signal SE is made to be "1" or "0" according to the result of comparison for controlling the gate circuit 117.

A case wherein the tone production control mode signal PC is "1" will firstly be described. This signal PC is applied to one input of the AND gate circuit 107, the other input thereof being supplied with the timing signal $T_1$ (FIG. 8) so that the output of the AND gate circuit 107 becomes 1 at the time slots [2] and [3] at which signal $T_1$ becomes "1". The output "1" of the AND gate circuit 107 is applied to the B selection control input SB of the selector 104, while the B input thereof is applied with the highest note key code outputted from the delay flip-flop circuit 116. At the time slots [2] and [3] in which signal "1" is applied to the B selection control input SB, the selector 104 selects the highest note key code applied to its B input from the delay circuit 116 and applies the selected key code to the A input of the comparator 110.

As above described, at the time slot [2] (the timing of pulse $T_1$s), the presently detected highest note key code is stored in the latch circuit 103 and this highest note key code is shifted to the latch circuit 109 from the latch circuit 103 so as to update the content of the highest note key code stored in the latch circuit 109 to a new (presently detected) highest note key code. At this time the delay circuit 116 outputs the highest note key code which has been stored in the latch circuit 109 two bit times before, that is the previously detected highest note key code. As a consequence, the data applied to the A input of the comparator via the B input of the selector 104 at time slot [2] (at the timing of pulse $T_{1s}$) corresponds to the previously detected highest note key code, and the data applied to the A input of adder 112 from the latch circuit 103 at this time corresponds to the presently detected highest note key code.

On the other hand the AND gate circuit 108 is enabled at the time slots [2] and [3] at which the timing signal $T_1$ becomes "1". To the other input of the AND gate circuit 108 is applied the tone production control signal SE. When this signal SE is "1", at time slots [2] and [3], the output of the AND gate circuit 108 becomes "1" so that the data supplied to the B input of the adder 112 becomes "0000100" (decimal 4). When the tone production control signal SE is "1", the gate circuit 117 is enabled to permit tone production of the previously detected highest note key code outputted from the delay circuit 116. In other words, a special musical tone based on the previously detected highest note would be generated. For the convenience of description, it is assumed now that signal SE is "1".

At the time slot [2], the adder 112 addes the presently detected highest note key code applied to its A input from the latch circuit 103 to data "0000100" applied to its B input and their sum S is applied to the B input of the comparator 110. The data "0000100" supplied to the B input of the adder 112 corresponds to an interval of 300 cents. As a result of addition of the presently detected highest note key code (A input) to data "0000100" executed by the adder 112, the sum output S obtained corresponds to a key code 300 cents higher than the presently detected highest note key code. Thus, as can be clearly noted from Tables II and III when "0000100" (decimal 4) is added to a certain key code (B3 through B1, N4 through N1), the resulting key code always represents a tone having a tone pitch of 3 semitones, that is 300 cents higher than the original key code.

Accordingly, the key code applied to the B input of comparator 110 from the adder 112 at the time slot [2] is a key code representing a tone 300 cents higher than the presently detected highest note key code. Where the previously detected key code supplied to the A input of the comparator 110 is the same or larger than an key code 300 cents higher than the presently detected highest note key code, that is the presently detected highest note key code is spaced more than 300 cents (minor three degrees) on the lower note side than the previously detected highest note key code, the result of comparison of comparator 110 becomes $A \geqq B$, thus producing an output "1". Conversely, when the previously detected highest note key code (A input) is smaller than a key code (B input) 300 cents higher than the presently detected highest note key code, that is when the presently detected highest note key code is in a range of 200 cents on the lower note side than the previously detected highest note key code (including a case wherein the present key code is higher than the previous one), the output $A \geqq B$ of the comparator 110 is "0".

At the time slots [2] and [3], signal "1" based on the timing signal $T_1$ is inputted to one input of the AND gate circuit 113 from the OR gate circuit 105. A signal obtained by inverting the carry signal Co produced by the adder 112 is also applied to the other input of the AND gate circuit 113. Consequently, at the time slots [2] and [3], so long as no carry signal Co is produced, the AND gate circuit 113 is always enabled to pass the output of the comparator 110. As the sum of the adder 112 overflows, the carry signal Co becomes "1" and the output of the inverter 114 becomes "0" thus disabling the AND gate circuit 113. In this case, since the comparator 110 can not perform a correct comparison due to the overflow of the adder 112, the output of the comparator 110 is blocked by the AND gate circuit 113.

The output of the AND gate circuit 113 is inverted by an inverter 118 and then applied to one input of an AND gate circuit 119 with its other input connected to receive the tone production control mode signal PC, and when the signal is "1", the AND gate circuit 119 is enabled to apply the output of the inverter 118 to a latch circuit 121 via the AND gate circuit 119 and an OR gate circuit 120. The control input L of this latch circuit 121 is supplied with a pulse $T_{1s}$ so that the output of the comparator 110 at the time slot [2] is latched in the latch circuit 121 via the AND gate circuit 113, the inverter 118, the AND gate circuit 119 and the OR gate circuit 120. Since the output of the comparator 110 is inverted by the inverter 118, where the presently detected highest note key code is spaced on the lower note side from the previously detected highest note key code by more than 300 cents (minor 3 degrees), a signal "0" is latched in the latch circuit 121, whereas when the presently detected highest note key code is in a range of 200 cents on the lower note side of the previously detected highest note key code (including a case wherein the present code is higher than the previous code), "1" would be latched in the latch circuit 121. When the output SE1 of the latch circuit 121 is "1", it means that the presently detected highest note key code is to be produced as a musical tone, whereas when the output is "0", it means that the tone production of the presently detected highest note key code should be inhibitted.

The output SE1 of the latch circuit 121 is applied to one input of an AND gate circuit 122, the other input thereof being supplied with a signal formed by inverting the coincidence signal EQ of a comparator 123 with an inverter 124. The A input of the comparator 123 is supplied with the output of the latch circuit 109, while B input is supplied with the output of the delay circuit 116. When the signals applied to the A and B inputs of the comparator 123 coincides with each other (A=B), a coincidence signal EQ of "1" is produced. By shifting the presently detected highest note key code from the latch circuit 103 to the latch circuit 109 at the time of generating the pulse $T_{1s}$, the latch circuit 109 would output the just received newly detected key code at the time slots [2] and [3], whereas the delay circuit 116 outputs old (previously detected) highest note key code which has been latched in the latch circuit 109 immediately before. When the old and new highest not key codes are not the same (due to variation of the highest note), the coincidence signal EQ outputted from the comparator 123 becomes "0", whereas when they are equal (the highest note does not vary) the coincidence signal EQ becomes "1". Consequently, only when the highest note varies, the output of the inverter 124 becomes "1" to enable the AND gate circuit 122 whreby the output SE1 of the latch circuit 121 is applied to a delay flip-flop circuit 126 via the AND gate circuit 122 and an OR gate circuit 125. The signal SE1 applied to the delay flip-flop circuit 126 is delayed two bit times by the timing pulses $\phi A'$ and $\phi B'$ (FIG. 8) and then applied to the one input of an AND gate circuit 127. The other input of this AND gate circuit 127 is supplied with a coincidence signal EQ outputted from the comparator 123.

After time slot [4], since the output of the latch circuit 109 and the output of the delay circuit 116 become equal, that is with the presently detected highest note key code, the coincidence signal EQ becomes "1". As a consequence, the output signal SE1 of the latch circuit 121 which was applied to the delay flip-flop circuit 126 according to the coincidence signal EQ of "0" at the time slots [2] and [3] at which the highest note was varied would be self-held in the flip-flop circuit 126 via the AND gate circuit 127 and the OR gate circuit 125. The output of this delay flip-flop circuit 126 is applied to the gate circuit 117 as a tone production control signal SE.

For this reason, similar to the output signal SE1 of the latch circuit 121, the tone production control signal SE is "0" when the presently detected highest note key code is spaced from the previously detected highest note key code on the lower tone side by more than 300 cents, whereas the signal SE1 is "1" when the presently detected highest note key code is in a range of 200 cents on the lower note side of the previously detected highest note key code. When the tone production control signal SE is "0", the gate circuit 117 is disabled so that the highest note key code latched in the latch circuit 109 is blocked by the gate circuit 117 and it will not be applied to the highest note key code memory devoce 26 (FIG. 7). In other words, the highest note key codes MKC* supplied from the gate circuit 117 to the highest note key code memory device 26 FIG. 7 become all "0", thereby inhibitting the production of the special musical tone based on the present highest note which is spaced from the previous highest note by more than 300 cents on the lower note side. When the tone production control signal SE is "1", the highest note key code latched in the latch circuit 109 would be applied to the highest note memory device 26 shown in FIG. 7 through the delay circuit 116 and the gate circuit 117 to act as the highest note key code MKC*.

The processing executed when the tone production control signal SE is "0" and the tone production is inhibitted will now be described. When the tone production control signal SE becomes "0", the AND gate circuit 108 is disabled so that its output is always "0". Thus, at time slots [2] and [3] in which the timing signal $T_1$ is generated, the data applied to the B input of the adder 112 is still maintained at "0000000" (decimal 0) so that the new (presently detected) highest note key code highest note key code applied to the A input of the adder 112 from the latch circuit 103 would be outputted from the adder 112 as it is. Thus, in this case, the output $A \geqq B$ of the comparator 110 becomes "1" when the presently detected highest note key code supplied to the B input of the comparator 110 is the same note or lower than the highest note key code (tone production thereof is inhibitted by the signal SE of "0") previously detected and applied to the A input of the comparator 110 from the delay circuit 116 via the selector 104, so that a signal "0" representing the tone production inhibition would be latched in the latch circuit 121. Where the tone pitch of the presently detected highest note key code is higher than that of the previously detected highest note key code, the output of the comparator 110 becomes "0" so that a tone production permission signal "1" is latched in the latch circuit 121. In the same manner as above described, the tone production control signal SE becomes "1" or "0" corresponding to "1" or "0" of the output signal SE1 of the latch circuit 121, and the tone production of a new highest note key code is controlled according to the state of the tone production control signal SE. As above described, where the tone production of the previous highest note key code is inhibitted, instead of checking whether the new highest note key code is apart or not from the previous highest note key code by more than 300 cents on the lower tone side, a judgement is made as to whether the tone pitch of the new highest note key code is higher or not than that of the previous highest note key code so as to prevent production of the highest note having a lower tone pitch than that of the previous highest note that was inhibitted from tone production because of its low tone pitch, thus causing unnaturality.

When the tone production control mode signal PC is "0", the AND gate circuits 107 and 119 are disabled so that above described tone production control processing would not be executed at the time of generating pulse $T_{1s}$ (time slot [2]). Instead a signal "1" formed by inverting signal PC with an inverter 128 is continuously applied to the latch circuit 121 via the OR gate circuit 120 so that the output signal SE1 of the latch circuit 121 is always "1". Hence the tone production control signal SE is always "1" with the result that the highest note key code latched in the latch circuit 109 always passes through the gate circuit 117 to reach the highest note key code memory device 26 shown in FIG. 7 as the highest note key code MKC*.

Although the output signal SE1 of the latch circuit 121 is almost the same as the tone production control signal SE, there arises the following advantage when signal SE1 is applied to the delay flip-flop circuit 126 (updating the tone production control signal SE) when the output EQ of the comparator 123 is "0", that is in synchronism with the change of the highest note.

More particularly, when the tone production control signal SE is "0" to inhibit the tone production of the highest note, as the tone production mode selection switch 28 (FIG. 1) is transferred from ON to OFF, the output signal SE1 of the latch circuit 121 changes from "0" to "1" at the time of generating the pulse $T_{1s}$. At this time, if the tone production control signal SE were immediately changed to "1" in response to the signal SE1, the highest note which has been inhibitted from tone production would be abruptly produced thus giving a unnatural feeling. In contrast, when the tone production control signal SE is updated in synchronism with the variation in the highest note as in this embodiment, above described unnatural feeling could be avoided.

However, if no trouble occurs by immediately permitting tone production when the tone production control mode selection switch 28 (FIG. 1) is transferred, the comparator 123 may be omitted in which case the circuit related to the tone production control signal SE may be changed as shown in FIG. 9*a* or FIG. 9*b*. In the example shown in FIG. 9*a*, the signal SE1 outputted from the latch circuit 121 (FIG. 6) is directely applied to a delay flip-flop circuit 126A to delay the signal SE1 two bit times according to the timing pulses $\phi A'$ and $\phi B'$ to form the tone production control signal SE. Such two bit time delay afforded by the delay flip-flop circuit 126A is necessary for producing the tone production control signal SE at the same time when presently detected highest note key code is supplied to the gate circuit 117 after being delayed by the delay flip-flop circuit 116 (FIG. 6). In the example shown in FIG. 9*b*, the comparator 123 and the latch circuit 121 (FIG. 6) have been omitted, wherein a signal outputted from the OR gate circuit 120 (FIG. 6) is applied to a delay flip-flop circuit 126B via an AND gate circuit 129 and an OR gate circuit 130 at the time slot [2] by the timing action of pulse $T_{1s}$. The signal applied to the delay flip-flop circuit 126B is held therein through an AND gate circuit 131 by the timing action of a signal obtained by inverting timing pulse $T_{1s}$. The output of the delay flip-flop circuit 126B constitutes the tone production control signal SE.

The highest note key code MKC* passed through the gate circuit 117 is applied to the highest note key code memory device 26 shown in FIG. 7 which is constituted by memory circuits 26-1 through 26-7 corresponding to respectively bits N1 through B3. Although only one memory circuit 26-1 is shown in detail, it should be understood that the other memory circuits have the same construction. The memory circuit 26-1 comprises an AND gate circuit 132 supplied with a predetermined one bit on the applied highest note key code MKC*, a delay flip-flop circuit 134 which is inputted with the output of an AND gate circuit 132 via an OR gate circuit 133 according to the timing pulse $\phi A'$ (FIG. 8), and outputs the received signal by the timing action of the timing pulse $\phi B'$ (FIG. 8), and a self-holding AND gate circuit 135 which feeds back the output of the delay flip-flop circuit 134 to its input side via the OR gate circuit 133. The other input of the AND gate circuit 132 is supplied with a write signal W through an AND gate circuit 136 of the key-on signal forming circuit 27, while the other input of the AND gate circuit 135 is supplied with a holding signal M through an inverter 137. The memory circuit 26-1 further comprises an exclusive-OR gate circuit 138 with one input supplied with a predetermined one bit (the same as that applied to the AND gate circuit 132) of the input key code MKC* and other input supplied with the output of the delay flip-flop circuit 134.

The output of the exclusive OR gate circuit 138 of each of the memory circuits 26-1 through 26-7 is applied to an OR gate circuit 139 in the key-on signal forming circuit 27. An OR gate circuit 140 of the key-on signal forming circuit 27 is supplied with respective bits of the highest note key code MKC*, and the output of the OR gate circuit 140 becomes "1" when either one of the bits of the keycode MKC* is "1", that is when any key code MKC* showing the highest note is supplied. The output "1" of the OR gate circuit 140 is applied to one inputs of AND gate circuits 136 and 141 as an any key code signal AKC. When the gate circuit 117 (FIG. 6) is disabled by "0" state of the tone production control signal SE, that is tone production of the highest note is inhibited, the any key code signal AKC would not be produced (that is "0"). The other input of the AND gate circuit 141 is supplied with the output of the OR gate circuit 139, and the output of the AND gate circuit 141 is applied to a waiting time setting timer 142.

The waiting time setting timer 142 starts its timer operation when the signal sent from the AND gate circuit 141 changes to "1" to measure a predetermined waiting time WT during which its output signal is "0". This output signal of the timer 142 is applied to the other input of the AND gate circuit 136, and outputted as a key-on signal SKON by being delayed a predetermined time by a delay circuit 143.

While the timer 142 is not measuring the waiting time WT, its output signal is "1" under which the output of the AND gate circuit 136 becomes "1" provided that the any key code signal AKC is "1". This is a normal state in which the output of the AND gate circuit 136, that is the write signal W is "1" and the holding signal M obtained by inverting the write signal W with the inverter 137 is "0". Under this normal state, respective bits of the highest note key code MKC* supplied from the gate circuit 117 (FIG. 6) of the highest note detection circuit 25 are delayed two bit times by the delay flip-flop circuit 134 via the AND gate circuits 132 in respective memory circuits 26-1 through 26-7, and outputted as the highest note key code MKC. Accordingly, the exclusive OR gate circuits 138 in the memory circuits 26-1 through 26-7 compare with each other the highest note key codes MKC* now being applied with the highest note key code MKC representing the content of the key codes MKC* two bit times before, for respective bits (N1 through B3). When the highest note key codes MKC* do not vary, the key codes MKC* and MKC are the same so that the outputs of the exclusive-OR gate circuits 138 of the memory circuits 26-1 through 26-7 are all "0". When the highest note key codes MKC* vary, their contents do not coincide with those of the key code MKC two bit times before so that either one of the output of the exclusive OR gate circuit 138 of any one of the memory circuits 26-1 through 26-7 becomes "1" whereby the output of the OR gate circuit 139 becomes "1".

The output "1" of the OR gate circuit 139 is applied to one input of the AND gate circuit 141 as a highest note variation detection signal ΔMKC. When the new key code MKC* after variation is not all "0" (that is when the any key code signal AKC is "1"), a signal "1" corresponding to the highest note variation detection signal ΔMKC is outputted from the AND gate circuit 141 and applied to the waiting time setting timer 142. The output thereof is "0" during a predetermined waiting time WT after the output of the AND gate circuit 141 has changed to "1" in response to the highest note variation detection signal ΔMKC. While the output of the timer circuit 142 is "0", the AND gate circuit 136 is disabled so that the write signal W is "0" and the holding signal M is "1". Accordingly, the new key codes MKC* after variation are blocked by the AND gate circuits 132 of respective memory circuits 26-1 through 26-7, whereas the old (before variation) highest note key codes MKC are stored and held through the AND gate circuits 135 and the delay flip-flop circuits 134 of respective memory circuits 26-1 through 26-7.

For this reason, even when the highest note key code MKC* varies, the highest note key code MKC outputted from the highest note key code memory device 26 does not vary immediately so that the old highest note key code MKC would be held for the predetermined waiting time WT. At this time, the key-on signals SKON outputted from the delay circuit 143 changes to "0" a predetermined time later than a time at which the output of the timer 142 has changed to "0", thus becoming "0" corresponding to the interval of the waiting time WT.

When the timer 142 completes the measuring of the waiting time WT, the output of the timer 142 changes to "1". At this time, the output of the AND gate circuit 136 becomes "1" provided that the any key code signal AKC is "1", the write signal W becomes "1" and the holding signal M becomes "0". As a consequence, the old highest note key code MKC is cleared when the waiting time WT terminates, and the new highest note key codes MKC* are applied to the delay flip-flop circuits 134 of respective memory circuits 26-1 through 26-7. Since the delay time of each delay flip-flop circuit 134 is set to be two bit times, the content of the key code MKC becomes the new highest note key code two bit times after an interval in which the output of the timer 142 has changed to "1". The output "1" of the timer 142 becomes a key-on signal SKON after being delayed a predetermined time by the delay circuit i43 so that this key-on signal SKON becomes "1" corresponding to the change of the new highest note key code MKC.

The highest note key code MKC outputted from the highest note key code memory device 26 and the key-on signal SKON outputted from the delay circuit 143 are applied to the special musical tone signal forming circuit 22 shown in FIG. 1. The special musical tone signal forming circuit 22 generates an envelope waveform signal in response to the building up of the key-on signal SKON to control the amplitude of the special musical tone signal having a tone pitch corresponding to the highest note key code MKC according to the envelope waveform signal, thus producing a special musical tone corresponding to the highest note of a melody.

The waiting time setting timer 142 is provided for the key-on signal forming circuit 27 for the following two reasons. One reason is to take into consideration variation in the key depression operations on the keyboard 10 (FIG. 1). For example, where a plurality of melody keys are simultaneously depressed, it is impossible to simultaneously depress the keys at an accuracy comparable with that (in microsecond units) of a digital system so that even when the performer depresses a plurality of keys at the same time, the actual key depression times of respective keys differ slightly from each other. Consequently, when a key not of the true highest note of simultaneously depressed keys for performing a melody is depressed firstly, the key code corresponding to that key may be detected by the highest note detection circuit 25 (FIG. 6) as the highest note key code MKC*. However, when all key codes N1* through B3* of a melody performed by simultaneously key depression are produced, the highest note key code MKC* is produced by the highest note detecting circuit 25 (FIG. 6) so that above described false highest note key code MKC* would be produced only for a short interval. In order to prevent the false highest note key code MKC* from being stored in the highest note key code memory device 26 shown in FIG. 7, during the waiting time WT, the storing of the highest note key code MKC* is inhibitted. For this reason, the waiting time WT is set to be about several milliseconds that can eliminate adverse effect caused by the difference in the operating times of a plurality of simultaneously depressed keys. As a consequence, near the end of the waiting time, the key code MKC* of the true highest note would be positively outputted from the highest note detecting circuit 25 shown in FIG. 6, so that only the highest note key code MKC* is stored in and outputted from the highest note key code memory device 26 as the key code MKC. Even when a plurality of keys are perfectly concurrently depressed, the depressed key detection and the tone production processings are not executed simultaneously for all depressed keys and lag by a time necessary for the key scanning and for the tone production assignment. For this reason too, it is necessary to provide the waiting time WT.

Another reason for providing the waiting time WT lies in that it is necessary to once clear to "0" the key-on signal SKON at the time of varying the highest note (when signal ΔMKC changes to "1") and cause it to change again to "1" after a definite time (waiting time WT). This makes it possible to change the key-on signal SKON to "1" when the highest note varies. During the response to this built-up signal "1", the special musical tone signal forming circuit 22 (FIG. 1) forms an envelope waveform signal for the tone production of a new highest note.

Modified Embodiment

In the foregoing embodiment, the multiplexed data KD1 through KD4 produced by the data multiplexer 17 shown in FIG. 2 were constituted by 4 bits, the mode signal ABC was sent out at time slot [2] as the data KD2 and in response to the mode signal ABC, the accompaniment note cancel circuit 24 (FIG. 5) blocks accompaniment key codes N1 through B3. For this reason, a shift register 101 was provided for the accompaniment note cancel circuit as shown in FIG. 5 for detecting the timings of the accompaniment channels by utilizing the output of the shft register 101. The accompaniment cancel circuit 24 can be simplified as shown in FIG. 10.

To simplify the accompaniment cancel circuit 24 as shown in FIG. 10, the following condition must be satisfied. Thus, it is necessary to add data KD5 representing the tone production mode of respective channels ch1 through ch10 (for a melody or an accompaniment) to the multiplexed data KD1 through KD4. Like data KD1 through KD4, data KD5 is formed by the data multiplexer 17 shown in FIGS. 1 and 2. Even when each one of the multiplexed data is constructed by five bits (KD1 through KD5), the construction of data KD1 through KD4 is substantially the same as that shown in FIG. 4. Only one difference is that in the circuit shown in FIG. 4, a mode signal ABC is sent out as data KD2 at time slot [2], whereas when data KD5 is added, the mode signal ABC is not sent out as data KD2 at the time slot [2].

In the normal mode (signal ABC is "0") the data KD5 is made to "1" in the forehalf time slots in which the multiplexed data of the channels ch1 through ch10 shown as U in row "ABC" shown in FIG. 4 are sent out, that is at odd numbered time slots [3], [5], [7], [9], [11], [13], [15], [17], [19] and [21], but made to "0" at other time slots. In the automatic bass chord mode (signal ABC is "1"), the data KD5 is made to be "1" at the forehalf time slots at the timings at which the multiplexed data of the melody channels ch7 through ch10 (shown by U at row ABC in FIG. 4) are sent out, that is time slots [15], [17], [19] and [21], whereas is made to be "0" in other time slots. As above described, formation of data KD5 in different modes depending upon the performance modes can be readily made by the data multiplexer 17 (FIG. 2) according to "1" or "0" of the mode signal ABC. Thus, "1" or "0" state of the data KD5 shows whether the channels are melody channels or not.

Data KD5 is delayed one bit time by a delay flip-flop circuit 144 of the data demultiplexer 23 shown in FIG. 10 and then applied to latch position L10 of a latch circuit 81' which corresponds to the latch circuit 81 shown in FIG. 5 and differs therefrom in that while the latch circuit 81 has 9 latch positions L1 through L9, the latch circuit 81' has 10 latch positions L1 through L10. Of the data KD5, effective data are sent out at odd numbered time slots as above described, the effective data is delayed one bit time by the delay flip-flop circuit 144 for the same reason as that of the octave codes B1 through B3 and key-on signal KON (see FIG. 4) sent out from the odd numbered time slots as data KD1 through KD4 are delayed one bit time by the delay flip-flop circuits 82 through 85. For this reason, when key codes N1 through N4, B1 through B3 and key-on signal KON regarding any channel are latched at latch positions L1 through L8 of the latch circuit 81', the latch position L10 is supplied with the content ("1" or "0") of the data KD5 of that channel.

The output from the latch position L10 of the latch circuit 81' is applied to one inputs of the AND gate circuits 93 through 99 of the accompaniment note cancel circuit 24 to act as an enabling signal ENB' which is "1" when key codes N1 through B3 inputted to the AND gate circuits 93 through 99 from the latch positions L1 through L7 of the latch circuit 81' are used for the melody channels, whereas "0" when the key codes are used for the accompaniment channels. Accordingly, only the key codes N1* through B3* for the melody channels are outputted from the accompaniment note cancel circuit 24, whereas the key code N1 through B3 for the accompaniment channels are canceled.

Further, as shown in FIG. 10, without using data KD5, a timing signal (which becomes "1" at the melody channel timing, and "0" at the accompaniment channel timing) just the same as the enabling signal ENB' outputted from the latch circuit 81' may be formed independently and used for controlling the AND gate circuits 93 through 99 of the accompaniment note cancel circuit 24.

The accompaniment note cancel circuit 24 shown in FIG. 5 or 10 selectively outputs the melody key codes N1 through B3 according to the enabling signal ENB or ENB' and eliminates or blocks the accompaniment key codes N1 through B3, but it is possible to select or block the key-on signal KON outputted from the latch position L8 of the latch circuit 81 or 81' instead of the key codes N1 through B3. In this case, the AND gate circuits 93 through 99 corresponding to respective bits of the key codes N1 through B3 are not necessary. Instead of providing these AND gate circuits, only one AND gate circuit is sufficient for controlling the selection or blocking a key-on signal KON outputted from the latch position L8. In this case, the accompaniment key codes N1 through B3 are applied to the highest note detection circuit 25 shown in FIG. 6 through the accompaniment note cancel circuit 24, and the accompaniment key codes are compared with the key codes latched in the latch circuit 103 (FIG. 3) by the comparator 110. However, since the key-on signal KON corresponding to the accompaniment note is blocked by the accompaniment note cancel circuit 24, the output of the OR gate circuit 105 (FIG. 6) becomes "0" to disable the AND gate circuit 113 (FIG. 6) with the result that the output $A \geqq B$ of the comparator 110 regarding the accompaniment key code (or the accompaniment channels) are always made ineffective.

It should be understood that the key informations selected or blocked by the accompaniment note cancel circuit 24 are not limited to key codes N1 through B3 but may be a key-on signal KON or the like.

Although in the foregoing embodiment the second musical tone production mode, that is the accompaniment performances contain a chord performance, a bass performance and an arpeggio performance, it is not necessary to contain all of these performances. For example, only a chord performance is sufficient in which case the accompaniment channels ch1 through ch5 are all used as the chord channels L.

Furthermore, although in the above described embodiment one (second mode) of the performance modes is an automatic bass chord mode, such function is not essential to this invention. Accordingly, the second musical tone production mode in the second mode is not necessarily be the automatic bass chord performance (and the arpeggio performance) but may correspond to a simple accompaniment tone color. More particularly, where the keyboard is divided into a melody key range and an accompaniment key range in the second mode, the melody key range may be made to correspond to the melody tone color, while the accompaniment key range may be made to correspond to only the accompaniment tone color. Moreover, where the keyboard and the musical tone production channels are divided, into two groups, it is not necessary to use one group for the melody and the other for the accompaniment. But it is only necessary to make two key ranges (or groups) to correspond to respective channel groups for forming musical tones with respective groups at different musical tone production modes (for example tone colors).

Although in the foregoing embodiment, the invention was applied to an electronic musical instrument of the single stage keyboard type, the invention is also applicable to an electronic musical instrument having a plurality of keyboards. For example the melody key range in the embodiment may be substituted by an upper keyboard while the accompaniment key range may be substituted by a lower keyboard. In this case although it is possible to use the key range (key group) corresponding to all channels (first musical tone production mode) in the first mode (normal mode) as an entire keyboard encluding upper and lower keyboards, to use only as the upper keyboard. In the second mode (automatic bass chord mode), the upper keyboard is made to correspond to a partial channel group for the first musical tone production mode, while the lower keyboard is made to correspond to the remaining channel group for the second musical tone production mode. Consequently, the key range (key group) corresponding to the first musical tone production mode (wherein the highest note is produced as the special musical tone) may be different for the first mode (normal mode) and the second mode (automatic bass chord mode) in the same manner as the melody key range described above. Further, like the upper keyboard the key range may be the same for the first and second modes.

As above described, according to this invention, the channels are divided into a channel group corresponding to a specific musical tone production mode (for example a melody performance) and a channel group corresponding to the other musical tone production mode (for example an accompaniment performance). According to a selected performance mode the key informations (codes) of the channels other than the specific musical tone production mode are excluded and the notes for the special musical tone are detected according to the key informations only for the specific musical tone production mode. Accordingly it is possible to effectively prevent admixing unnatural elements (notes based on the other musical tone production mode, for example the accompaniment performance) with the melody progression of a special musical tone.

What is claimed is:

1. An electronic musical instrument comprising:

a keyboard provided with a plurality of keys;

designating means for designating one of at least first and second performance modes;

tone production means including a plurality of tone production channels smaller in number than that of said keys, which produces a musical tone corresponding to a depressed key;

dividing means for dividing said keys into at least two key groups, and for dividing said tone production channels into the same number of tone production channel groups as that of said key groups, each of said key groups corresponding to one of said tone production channel groups when said first performance mode is designated by said designating means;

assigning means for assigning key information data corresponding to said depressed key to an available channel of the tone production channel group corresponding to the key group to which said depressed key belongs when said first performance mode is designated by said designating means, and for assigning key information data corresponding to said depressed key to an available channel of said plurality of tone production channels when said second performance mode is designated by said designating means; and special tone production means for producing a special tone relating to special key information data assigned to the tone production channel group corresponding to a predetermined key group among said key groups when said first performance mode is designated, and for producing a special tone relating to special key information data assigned to said tone production channel corresponding to a predetermined key group among said key groups when said second performance mode is designated, said special tone having tonal quality different from that of the musical tone produced from said tone production means.

2. An electronic musical instrument according to claim 1 wherein said special tone production means comprises cancel means for cancelling key information data other than those of said tone production channel group corresponding to said first performance mode and for cancelling key information data other than those of said tone production channel corresponding to said second performance mode, and means for detecting said special key information data among key information data selected by said cancel means.

3. An electronic musical instrument according to claim 1 wherein said first performance mode is a melody performance, and wherein said second performance mode is an accompaniment performance.

4. An electronic musical instrument according to claim 1 wherein said special tone production means comprises means responsive to the performance mode designated by said performance mode designating means, and selects key information data of said tone production channels when said first performance mode is designated, and cancels key information data of the tone production channels when said second performance mode is designated.

5. An electronic musical instrument according to claim 1 wherein said special tone production means comprises means for detecting key information data corresponding to an extreme note among key information data of said tone production channels.

6. An electronic musical instrument according to claim 1 wherein said assignment means comprises circuit means which produces, on time division basis, key information data assigned to respective musical tone production channels.

7. An electronic musical instrument according to claim 2 wherein said cancel means comprises gate means which blocks said key information data when a signal outputted together with said key information data represents said second performance mode and selects and outputs said key information data when said signal represents said first performance mode.

8. An electronic musical instrument according to claim 1 wherein said special tone production means comprises a note detection circuit which detects key information data corresponding to an extreme note among key information data selected by said cancel means, and tone production control means which when the key information data presently detected by said note detection circuit are apart, in time, from the key information data detected by said note detection circuit immediately before by more than a predetermined time interval, inhibits said special tone production means from producing said special tone.

9. An electronic musical instrument according to claim 8 which further comprises switch means which controls operation of said second performance means.

10. An electronic musical instrument according to claim 1 wherein said electronic musical instrument includes in addition to said keyboard at least one other keyboard.

* * * * *

UNITED STATES PATENT AND TRADEMARK OFFICE

CERTIFICATE OF CORRECTION

PATENT NO. : 4,402,245

DATED : September 6, 1983

INVENTOR(S) : Oya, et al.

It is certified that error appears in the above-identified patent and that said Letters Patent is hereby corrected as shown below:

| COLUMN | LINE | |
|---|---|---|
| 5 | 13 | Please delete "circui" and insert --circuit--. |
| 5 | 27 | Please delete "19" and insert --10--. |
| 6 | 60 | Please delete "CK" and insert --KC--. |
| 8 | 33 | Please delete "channels" and insert --cancels--. |
| 8 | 46 | Please delete "produce the only" and insert --produce only--. |
| 8 | 56 | Please delete "molody" and insert --melody--. |
| 10 | 55 | Please delete "couner" and insert --counter--. |
| 11 | 17 | Please delete "(See $\overline{ABC}$)" and insert --(see ($\overline{ABC}$)--. |

UNITED STATES PATENT AND TRADEMARK OFFICE

CERTIFICATE OF CORRECTION

PATENT NO. : 4,402,245

DATED : September 6, 1983

INVENTOR(S) : Oya, et al.

It is certified that error appears in the above-identified patent and that said Letters Patent is hereby corrected as shown below:

| COLUMN | LINE | |
|---|---|---|
| 14 | 28 | Please delete "The the" and insert --In the--. |
| 17 | 37 | Please delete "LD-KL" and insert --LD=KL--. |
| 19 | 12 | Please delete "chlord" and insert --chord--. |
| 19 | 67 | Please delete "theroot" and insert --the root--. |
| 20 | 1 | Please delete "0" and insert --1--. |
| 20 | 64 | Please delete "BT4" and insert --BT5--. |
| 21 | 31 | Please delete "7th" and insert --7th--. |
| 21 | 33 | Please delete "min" and insert --min--. |
| 21 | 33 | Please delete "7th" and insert --7th--. |
| 21 | 37 | Please delete "min" and insert --min--. |

UNITED STATES PATENT AND TRADEMARK OFFICE

CERTIFICATE OF CORRECTION

PATENT NO. : 4,402,245

DATED : September 6, 1983

INVENTOR(S) : Oya, et al.

It is certified that error appears in the above-identified patent and that said Letters Patent is hereby corrected as shown below:

| COLUMN | LINE | |
|---|---|---|
| 21 | 37 | Please delete "7th" and insert --7th--. |
| 21 | 39 | Please delete "min" and insert --min--. |
| 21 | 39 | Please delete "7th" and insert --7th--. |
| 22 | 22 | Please delete "means" and insert --name--. |
| 22 | 28 | Please delete "key" and insert --keys--. |
| 24 | 1 | Please delete "[>]" and insert --[22]--. |
| 24 | 8 | Please delete "5" and insert --25--. |
| 24 | 23 | After the word "and" please delete the word "the". |
| 25 | 10 | Please delete "for" and insert --from--. |
| 25 | 34 | Please delete "more" and insert --note--. |

UNITED STATES PATENT AND TRADEMARK OFFICE

CERTIFICATE OF CORRECTION

PATENT NO. : 4,402,245

DATED : September 6, 1983

INVENTOR(S) : Oya, et al.

It is certified that error appears in the above-identified patent and that said Letters Patent is hereby corrected as shown below:

| COLUMN | LINE | |
|---|---|---|
| 25 | 42 | Please delete "on" and insert --an--. |
| 25 | 65 | Please delete "[5" and insert --[5]--. |
| 25 | 66 | Please delete "[3" and insert --[3]--. |
| 26 | 41 | Please delete "∂2]" and insert --[2]--. |
| 27 | 5 | Please delete "As" and insert --At--. |
| 31 | 42 | Please delete "whreby" and insert --whereby--. |
| 32 | 9 | Please delete "devoce" and insert --device--. |
| 33 | 65 | Please delete "respectively" and insert --respective--. |
| 34 | 2 | Please delete "on" and insert --of--. |

UNITED STATES PATENT AND TRADEMARK OFFICE

CERTIFICATE OF CORRECTION

PATENT NO. : 4,402,245

DATED : September 6, 1983

INVENTOR(S) : Oya, et al.

It is certified that error appears in the above-identified patent and that said Letters Patent is hereby corrected as shown below:

| COLUMN | LINE | |
|---|---|---|
| 37 | 24 | Please delete "ABC" and insert --$\overline{ABC}$--. |
| 42 | 2 | Please delete "second". |

Signed and Sealed this

*Ninth* Day of *September 1986*

[SEAL]

*Attest:*

DONALD J. QUIGG

*Attesting Officer*

*Commissioner of Patents and Trademarks*